US012163768B2

(12) United States Patent
Larsen

(10) Patent No.: US 12,163,768 B2
(45) Date of Patent: Dec. 10, 2024

(54) SPORTS SHOOTING TARGET AND CORRESPONDING LAUNCHING DEVICE AND APPARATUSES

(71) Applicant: Nordic Sporting Clays ApS, Copenhagen K (DK)

(72) Inventor: Jens Larsen, Copenhagen K (DK)

(73) Assignee: NORDIC SPORTING CLAYS APS, Copenhagen K (DK)

( * ) Notice: Subject to any disclaimer, the term of this patent is extended or adjusted under 35 U.S.C. 154(b) by 159 days.

(21) Appl. No.: 17/610,686

(22) PCT Filed: Apr. 6, 2020

(86) PCT No.: PCT/DK2020/200086
§ 371 (c)(1),
(2) Date: Nov. 11, 2021

(87) PCT Pub. No.: WO2020/253923
PCT Pub. Date: Dec. 24, 2020

(65) Prior Publication Data

US 2022/0178661 A1 Jun. 9, 2022

(30) Foreign Application Priority Data

Jun. 19, 2019 (DK) ..... PA 2019 00739

(51) Int. Cl.
*F41J 1/01* (2006.01)
*A63H 33/18* (2006.01)
(Continued)

(52) U.S. Cl.
CPC . *F41J 9/32* (2013.01); *F41J 1/01* (2013.01); *F41J 9/30* (2013.01); *A63H 33/18* (2013.01)

(58) Field of Classification Search
CPC ..... A63H 27/00; A63H 33/18; A63B 67/16; A63B 67/06; F41J 1/01; F41J 9/32; F41J 9/18; F41J 9/16
USPC ..... 446/46, 48
See application file for complete search history.

(56) References Cited

U.S. PATENT DOCUMENTS 1,131,762 A * 3/1915 Whipple ..... F01D 5/225 415/173.6
3,394,906 A * 7/1968 Rogers ..... B64C 39/001 446/37

(Continued)

FOREIGN PATENT DOCUMENTS

DK 3279604 * 2/2018 ..... F41J 9/16

*Primary Examiner* — John E Simms, Jr.
(74) *Attorney, Agent, or Firm* — Leason Ellis LLP

(57) ABSTRACT

The invention relates to a sports shooting target made of a biodegradable material, the target having a rotational axis (z) and attachment means (2, 4', 4", 10, 11, 15) for releasable attachment to a launching device, where the target is provided with trajectory stabilizing means that are configured to stabilize the trajectory of the target by gyro effect caused by rotation about said rotational axis (z) which stabilizing means further function as propelling means that cause forward movement of the target along its trajectory due to the rotation about said rotational axis (z), when the target is rotating, where said stabilizing means comprises a fan comprising fan blades (3', 3") that rotates in unison with the target, when the target rotates, such that the stabilizing means both provides said stabilizing gyro effect and forward propulsion (movement) of the target along a chosen trajectory. The target comprises a hub portion (2, 15) configured for releasable attachment to a corresponding portion of a launching device and a plurality of concentric ring members (5, 6, 7; 12, 13, 14) arranged about the rotational axis (z) of the target at different distances ($r_5$, $r_6$, $r_7$) from the rotational axis (z) and outside the hub portion (2) The stabilizing (Continued)

means comprises first fan blades (3') that extend radially from the hub portion (2, 15) to the ring member (7, 14) provided at the largest distance from the rotational axis (z) and second fan blades (3") that extend radially between two adjacent ring members. The invention further relates to a launching device for launching the target, launching apparatuses comprising the launching device of the invention as well as a method of launching targets for skeet shooting and similar sport shooting activities.

6 Claims, 27 Drawing Sheets

(51) Int. Cl.
*F41J 9/30* (2006.01)
*F41J 9/32* (2006.01)

(56) References Cited

U.S. PATENT DOCUMENTS 3,605,328 A * 9/1971 Kilroy ..... A63H 27/14 124/16
3,742,643 A * 7/1973 Keith ..... A63H 27/12 446/46
3,838,835 A * 10/1974 Kling ..... B64C 27/20 416/129
5,030,157 A * 7/1991 Silverglate ..... A63H 33/18 446/36
5,348,509 A * 9/1994 Riccardi ..... A63H 33/18 446/475
8,608,598 B2 * 12/2013 Hoang ..... A63H 33/18 473/590
2002/0098768 A1 * 7/2002 Kuo ..... A63H 27/14 446/40
2003/0119415 A1 * 6/2003 Kaisio ..... A63H 1/30 446/46
2008/0153381 A1 * 6/2008 Schenk ..... A63H 27/12 446/40
2008/0308085 A1 * 12/2008 Polk, III ..... F41F 7/00 124/1
2009/0013983 A1 * 1/2009 Polk, III ..... A63H 27/14 124/6
2014/0070493 A1 * 3/2014 Gonzalez ..... A63B 67/06 473/588
2017/0114778 A1 * 4/2017 Madson ..... F03D 13/10

* cited by examiner

SPORTS SHOOTING TARGET AND CORRESPONDING LAUNCHING DEVICE AND APPARATUSES

TECHNICAL FIELD

The present invention relates to the field of sports shooting targets and apparatuses for launching such targets and more particularly to improvements of targets and apparatuses with the aim to reduce environmental hazards caused by the targets and to improving trajectory stability of targets after launching from launching apparatuses.

BACKGROUND OF THE INVENTION

Prior art sports shooting targets, such as clay pigeons, are made of limestone and a binding material, such as pitch, bitumen or another organic material and weighs typically about 105 to 110 grams. The binder materials may contain components that can pose a potential risk to the environment. The binder material may contain a mixture of different hydrocarbons caned polycyclic aromatic hydrocarbons (PAH) and some of these are known to be toxic.

Prior art launching apparatuses comprise a throwing arm that can be rotated about a rotational axis and onto which a sports shooting target is provided from a supply container at a distance from the rotational axis. Longitudinally opposite the rotational axis, the throwing arm has a free end portion from which a target provided on the arm will be launched due to the centrifugal force exerted on the target by the rotation of the throwing arm. Traditional sports shooting targets are not provided with stabilizing means that act to stabilize the trajectory or trajectory of the target after it has left the launching apparatus. The lack of stabilizing means in the prior art target may not pose a serious problem for targets of relatively heavy weights, but for very light weight targets, the trajectory will be rather unstable and unpredictable.

The use of traditional clay pigeons is prohibited in many locations in the world due to the risk of polluting, the environment. Especially, in the vicinity of ground water drillings, the use of traditional clay pigeons is widely prohibited. There is a current tendency that the prohibition of the use of traditional clay pigeons may be generally implemented during the coming years. Hence there is a need to provide a replacement of the traditional day pigeon that solves the environmental issues, but still make traditional clay pigeon shooting possible, substantially without altering the behavior of the new kind of sports shooting target after launching from a launching apparatus. The new kind of sports shooting target should thus be able to offer a hunter or sports shooter the same experience as the traditional type of clay pigeon does.

There is hence a need for a sports shooting target and corresponding launching apparatus that will solve both the environmental issues addressed above and provide a more stable and predictable trajectory of the target.

OBJECTIVE OF THE PRESENT INVENTION

An object of the present invention is to provide a lightweight sports shooting target that despise its low weight has improved trajectory stability after launching.

A further object of the present invention is to provide a sports shooting target that reduces or even eliminates the risk of polluting the environments.

A further object of the present invention is to provide a sports shooting target that is cheap to manufacture, especially much cheaper than traditional clay pigeons.

A further object of the invention is to provide a very light weight sports shooting target, thereby rendering it possible to ship large quantities of targets throughout the world at a very low prize.

A further object of the present invention is to provide a sports shooting target with enhanced visibility after launching.

A further object of the present invention is to provide launching devices and apparatuses that is specifically suited to launch the very light and fragile target of the invention without damaging, the target. During use of the invention, the target must be accelerated from zero rotational speed to a very high final rotational speed, typically in the order of 20000 rpm and it is absolutely essential that the acceleration of the target and its release from the launching device does not stress the target and causes disintegration of the target.

A further object of the invention is to provide a launching apparatus that can function automatically and that can accommodate a very large number of targets ready for launching, it is a further object of the invention to provide a version of a launching apparatus that can stand on a suitably support means on the ground or on the ground itself.

It is a further object of the invention to provide a programmable launching apparatus that can easily be programmed by a user.

It is a further object of the invention to provide an advantageous method for performing sports shooting activities, particularly skeets shooting, and event at which a plurality of sports shooting targets can be launched such that a variety of interesting scenarios can be created.

It is a further object of the invention to provide a version of a launching apparatus that is hand-held.

DISCLOSURE OF THE INVENTION

The above and further objects and advantages are according to a first aspect of the invention obtained by a sports shooting target according to the invention.

The present invention provides an environmentally advantageous alternative to traditional clay pigeons. The sports shooting targets of the invention moves substantially in the same manner as traditional clays pigeons, such that a sports shooter will have substantially the same experience and pleasure when using the sports shooting targets of the invention as when using traditional clay pigeons.

Due to their low weight the sports shooting targets of the invention can be manufactured at a central location, where they can be cheaply manufactured, and distributed throughout the world from this centralized location.

An important feature of the sports shooting target according to the present invention is that its weight is very much reduced compared to traditional sports shooting targets. The weight of such prior art targets is typically in the range 100 to 110 grams, whereas the sports shooting target according to the present invention typically weighs less than 10 grams, typically in the range 6 to 8 grams.

Another important feature of the sports shooting target according to the present invention is that it is configured to obtain maximum directional stability, such that it—despise the very low weight of the target—is able to follow a stable trajectory in space after being launched from a launching apparatus. According to the invention, this stabilizing effect is obtained by gyroscopic, means.

In an embodiment of the sports shooting target according to the invention, a combined gyro-stabilizing effect and a forward propelling effect is obtained by configuring the target as a circular object that after launching rotates about its rotational axis—whereby the gyro-stabilizing effect is obtained—and where the circular object is provided with fan means that, when rotating about the rotational axis of the target, propels the target in a desired forward direction along a trajectory originating from a launching apparatus that provides the necessary rotation of the target that ensures the gyroscopic effect and the forward propulsion of the target along the trajectory. Different embodiments of targets according to the invention are shown and described below.

In the following, the term "propelling means" and "propelling effect" are used repeatedly, By "propelling means" is meant means (elements, members, etc.) provided as a part of the sports shooting target according to the first aspect of the invention, and which propelling means functions to move the target along a trajectory in the air after the target has been launched by the apparatus according to the second aspect of the invention. The propelling effect is the forward moving effect caused by the propelling means along its trajectory.

Still another important feature of the sports shooting target according to the first aspect of the present invention is that it is made of a biodegradable material in order to reduce or eliminate environmental hazards.

The present invention comprises five aspects: The first aspect is a target according to the invention; the second aspect is a launching device configured to launch the target when it has been rotated to a desired final rotational speed; the third aspect is an apparatus comprising the launching device according to the second aspect of the invention; the fourth aspect is a method of launching targets for skeet shooting and similar sport shooting activities; and the fifth aspect is a hand-held apparatus comprising the launching device according to the second aspect of the invention.

According to a first aspect of the present invention there is thus provided a sports shooting target made of a biodegradable material, the target having a rotational axis and attachment means configured for releasable attachment of the target to a launching head of a launching device according to the second aspect of the invention, where the target is provided with trajectory stabilizing means that are configured to stabilize the trajectory of the target by gyro effect caused by rotation about the rotational axis, which stabilizing means further function as propelling means that cause forward movement of the target along its trajectory due to the rotation about said rotational axis, when the target is rotating and released form the launching device, where the stabilizing means comprises a fan comprising fan blades that rotate in unison with the target, when the target rotates, such that the stabilizing means both provides the stabilizing gyro effect and forward propulsion (movement) of the target along a chosen trajectory; where:

the sports shooting target comprises a hub portion configured for releasable attachment to a corresponding portion of a launching head of a launching device, which portion of the launching head, when the target is attached to it, can rotate said target and release it from the launching device, when a desired terminal rotational speed has been reached; and the hub portion is provided with an inner circumferential surface facilitating release of the target from the portion of the launching head and defining an inner space;

the target comprises a plurality of concentric ring members arranged about the rotational axis of the target at different distances $r_5$, $r_6$, $r_7$ from the rotational axis and outside the hub portion; and the stabilizing means comprises first fan blades that extend radially from the hub portion to the ring member provided at the largest distance from the rotational axis and second fan blades that extend radially between two adjacent ring members.

In an embodiment of the first aspect the inner circumferential surface of the hub portion is conical.

In an embodiment of the first aspect the ring members have cross-sectional shapes comprising curved first and second side faces, where the first and second side faces meet at a substantially sharp edge portion, thereby optimizing the aero-dynamic properties of the respective ring members.

In an embodiment of the first aspect the second fan blades are provided between the outermost ring member and the adjacent ring member.

In an embodiment of the first aspect the inclination angle of the fan blades relative to the (x, y) plane of the target increases towards the hub portion.

In an embodiment of the first aspect, the hub portion of the target comprises inwardly sloping surfaces that converge towards the longitudinal rotational axis of the target, and are of similar extension and slope angle relative to the longitudinal axis, whereby it becomes possible to attach the hob portion of the target to the launching head from either side of the target, i.e. the target according to this embodiment is reversible or "turnable".

According to a second aspect of the present invention there is provided a launching device for launching the target according to the first aspect, the launching device comprising a launching head configured such that the hub portion of the target can be positioned on the launching head, where the launching head comprises a plurality of pivotally mounted retaining claw members that are configured to be able to pivot between a first state, in which the claw members retain the hub portion of the target to the launching head and a second state, in which the claw members release the hub portion of the target from the launching head, where the apparatus is provided with a longitudinally displaceable shaft member or rod that is functionally connected to the claw members such that a longitudinal displacement of the shaft member results in a pivotal movement of the claw members, whereby a longitudinal displacement of the shaft member from a first longitudinal position of the shaft member to a second longitudinal position of the shaft member makes the claw members pivot between the first state and the state and/or vice versa, where the device is provided with shaft member operating means configured to displace the shaft member between the first and second longitudinal positions and launching head rotating means configured to rotate the launching head and to accelerate the launching head from substantially zero rotational speed to a maximum rotational speed, at which maximum rotational speed of the launching head, the hub portion of the target is released from the launching head.

In an embodiment of the second aspect the pivotal movement of the retaining claw members is obtained by engagement of an inner guide member that is fixedly attached to the longitudinal shaft member in the launching head and a correspondingly shaped recess or extension in the retaining claw members, and where an outer portion or extension of the claw members are in contact with an inner circumferential surface of the launching head, such that when the longitudinal shaft member is displaced in the positive longitudinal direction (z), the retaining claw members are forced to pivot between the state where they retain the hub portion of the target to the launching head, and the state where they release the hub portion of the target from the launching head.

In an embodiment of the second aspect the device comprises a first motor (for instance an electro motor) comprising a rotational axle and configured to rotate the launching head upon which the target can be placed; and wherein the launching head comprises:

- an inner guide member fixedly connected to the rotational axle and provided with a circumferentially extending guide recess or groove formed for engagement with an inwardly extending protrusion on the retaining claw members;
- an outer guide member comprising an inner space that surrounds the inner guide member, which outer guide member is configured to undergo a longitudinal displacement (D) relative to the inner guide member and to rotate in unison with the inner guide member, where the outer guide member on a wall portion of the inner space hereof is provided with a circumferentially extending recess or groove formed for engagement with a corresponding outer extension of the retaining claw member;
- a plurality of retaining claw members each provided with an inner protrusion in engagement with the circumferentially extending guide recess or groove on the inner guide member and an outer protrusion in engagement with the circumferentially extending recess or groove;

whereby a longitudinal displacement (D) of the outer guide member relative to the inner guide member will cause the retaining claw members to pivot between said two states.

In an embodiment of the second aspect the device comprises longitudinal displacement means configured to displace the outer guide member in a direction (D) relative to the inner guide means, where the longitudinal displacement means comprises,

- a longitudinal displacement motor or similar means operatively connected to the shaft member or rod via a rotation-to-displacement mechanism that converts a rotational movement provided by the longitudinal displacement motor to a longitudinal displacement (D);
- a laterally extending plate member functionally connected to the outer guide means such that a longitudinal displacement (D) of the plate member causes the outer guide member to undergo a longitudinal displacement relative to the inner guide member;
- where the shaft member or rod is connected to the laterally extending plate member.

In an embodiment of the second aspect the outer guide means is configured to be able to undergo the above described longitudinal displacement as well as rotation in unison with the inner guide member.

In an embodiment of the second aspect the outer guide member is rotatably connected to the laterally extending plate member via a ball bearing which makes it possible for the outer guide member to undergo both longitudinal displacement and to rotate in unison with the inner guide means.

In an embodiment of the second aspect, the retaining claw members comprise an upper section (I) and a lower section (II), the upper mention comprising a retaining claw configured for retaining engagement with the hub portion of the target according to the first aspect, and extending above a line L connecting the center points of the inner extension and the outer extension of the claw member, and the lower section extending below the line L, where the retaining claw member has its center of gravity located on the line L, where the launching device is configured suet that when the retaining claw members release the target from the launching head, the line L forms an angle with the longitudinal rotational axis R of the launching head of substantially 90 degrees.

Thereby, the section I of the claw member located above the center of gravity and the section II of the caw member located below the center of gravity are exposed to equal centrifugal forces, when the launching head rotates about the longitudinal rotational axis R. This configuration of the claw members results in that the force which must be transferred from the the longitudinal displacement motor via the longitudinally extending shaft or rod to the outer extension of the retaining claw member that is required for releasing the target from the launching head is minimized.

According to a third aspect of the present invention there is provided a launching apparatus comprising one or more launching devices according to the second aspect of the invention, where the launching, apparatus further comprises:

- for each of the launching devices, at least one magazine or container configured to contain a plurality of targets according to the first aspect of the invention;
- for each of the launching devices means configured to transfer a target to the launching head of the launching device;
- for each of the launching devices, a pivot mechanism operated by pivot operating means such that the launching device can be pivoted to a desired launching angle relative to horizontal that is desired for a specific application of the apparatus;
- control means configured to control one or more of the following functions of the apparatus: loading of a target onto the launching head, starting rotating the launching head with the target thereon and acceleration it to a final desired rotation speed at which the target can be released from the launching head, adjusting the pivot angle of the launching devices;
- sensor means configured to determine if a desired final rotational speed of the launching head has been reached and if this is the case, instructing the control means to effect the release of the target by pivoting the retaining claw members to pivot to the state in which the target is released from the launching head.

In an embodiment of the third aspect, the launching apparatus comprises programmable control means configured to control the operation of the functions of the apparatus and the functions of the one or more launching devices provided in the apparatus, the programmable control means comprising a control unit, such as a microcontroller, where the control unit it is configured to receive control signals from a user control panel, control signals from a user programming interface and a release process activation signal from a user interface, such as a pedal; and where the control unit is configured to provide control signals for controlling functionalities of the apparatus, where these control signals comprise one or more of the following:

- a first control signal controlling rotation of the magazines of the apparatus, such that a desired magazine is positioned correctly for loading a target onto the launching head of a specific launching device;
- a second control signal controlling displacement of the target receiving tray between a position, in which a target is picked up from the magazine above the tray and a position, in which the target can be loaded onto the launching head;
- a third control signal controlling the elevation angle of the launching device;

a fourth control signal controlling initiation of the release procedure of the target;

a fifth control signals controlling the azimuth angle of the launching device;

a sixth control signal that indicated if the desired final rotational speed of the launching head has been reached and hence, that the target can be released from the launching, head;

a seventh control signal providing the control unit with user definable information from a user control panel;

an eight control signal providing the control unit with programming information from a user programming interface that allows a user to program functionalities of the apparatus.

A ninth control signal providing the control unit with a trigger signal that initiates the release procedure of the launching device.

In an embodiment of the third aspect, one or both of the control signals from the user programmable interface and trigger signal are provided to the control unit by wireless communication means.

In an embodiment of the third aspect, the control unit is configured to provide and/or receive a control signal to/from other launching apparatuses according to the invention, such that a chain of interconnected launching apparatuses according to the invention can be set up.

According to a fourth aspect of the present invention, there is provided a method of launching targets for skeet shooting and similar sport shooting activities, the method comprising:

providing at least one launching apparatus according to the third aspect of the invention;

providing a plurality of targets according to the first aspect of the invention;

loading targets into a magazine of the launching apparatus(es);

from a magazine of each specific of said launching apparatus(es) loading a target onto the launching head of one or more launching devices provided in the one or more of the launching, apparatus(es);

adjusting the elevation angle of each individual launching device to a desired elevation angle value;

adjusting the azimuth angle of each individual launching device to a desired azimuth value;

defining a final rotational speed of the launching head of each individual launching device at which rotational speed the target shall be released from the specific launching head;

by means of a user operable means, such as a pedal, initiating the release procedure for the target located on the launching head of the specific launching device.

In an embodiment of the fourth aspect, a plurality of functionally interconnected launching apparatuses according to the third aspect of the invention are provided and the steps defined above are executed for each individual of the plurality of launching apparatuses.

According to a fifth aspect of the present invention there is provided hand-held launching apparatus configured to launch a target according to the first aspect of the invention, where the hand-held launching apparatus comprising a launching device according to the second aspect of the invention, where the hand-held launching apparatus further comprises:

control means configured to control one or more of the following functions of the apparatus, starting rotating the launching head with the target thereon and acceleration it to a final desired rotation speed at which the target can be released from the launching head;

sensor means configured to determine if the desired final rotational speed of the launching head has been reached and if this is the case instructing the control means to effect the release of the target by pivoting the retaining claw members to the state in which the target is released from the launching head;

user-operating trigger means configured to start the rotation of the launching head.

BRIEF DESCRIPTION OF THE DRAWINGS

Further benefits and advantages of the present invention will become apparent after reading the detailed description of non-limiting exemplary embodiments of the invention in conjunction with the accompanying drawings, wherein.

DETAILED DESCRIPTION OF THE INVENTION

The principles of the invention will be illustrated by various embodiments hereof. It is however understood that a person skilled in the art may conceive other embodiments than those actually shown and described in the detailed description of the invention and that the scope of the invention is defined by the independent claims.

Figure 1:
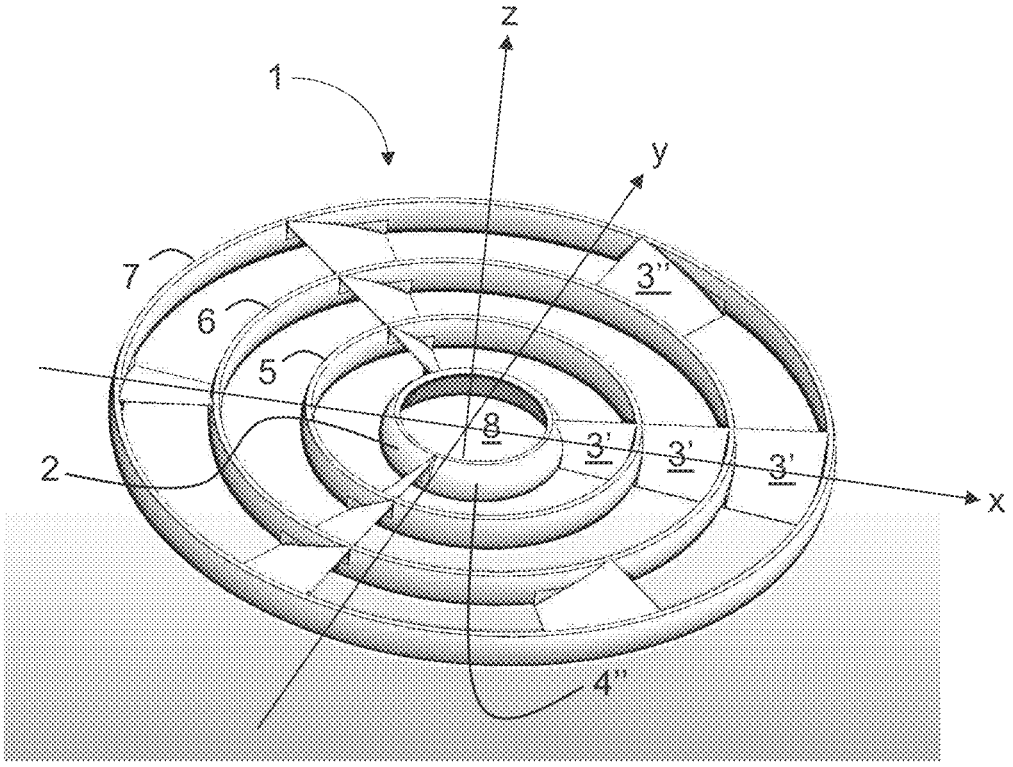
FIG. 1 shows a schematic perspective view of a first embodiment of a sports shooting target according to the invention seen from above.
Figure 2:
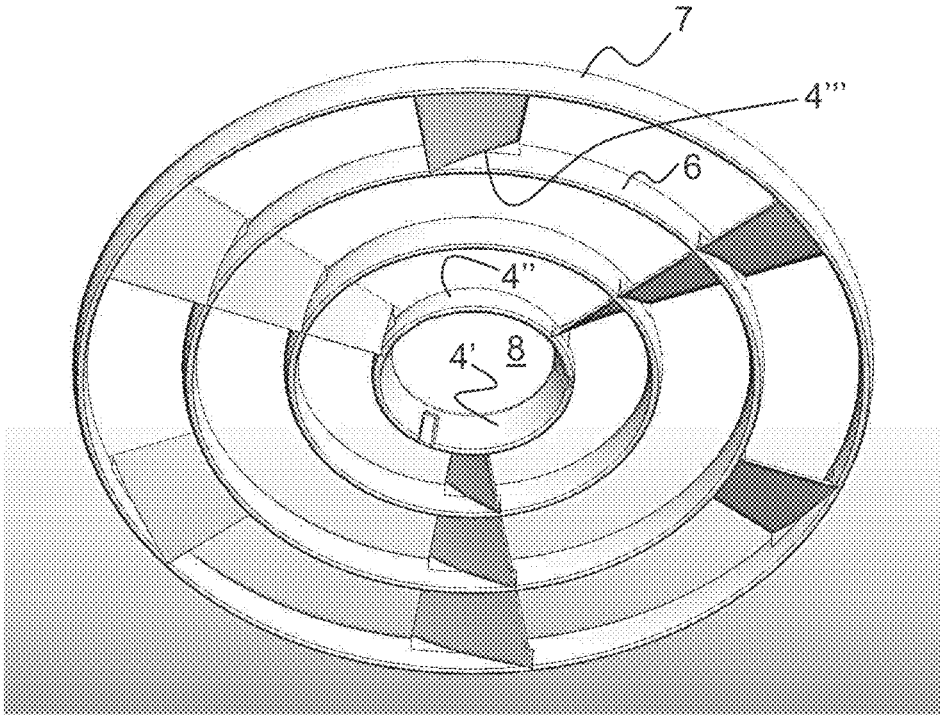
FIG. 2 shows a schematic perspective view of the first embodiment of a sports shooting target according to the invention seen from below.
Figure 3:
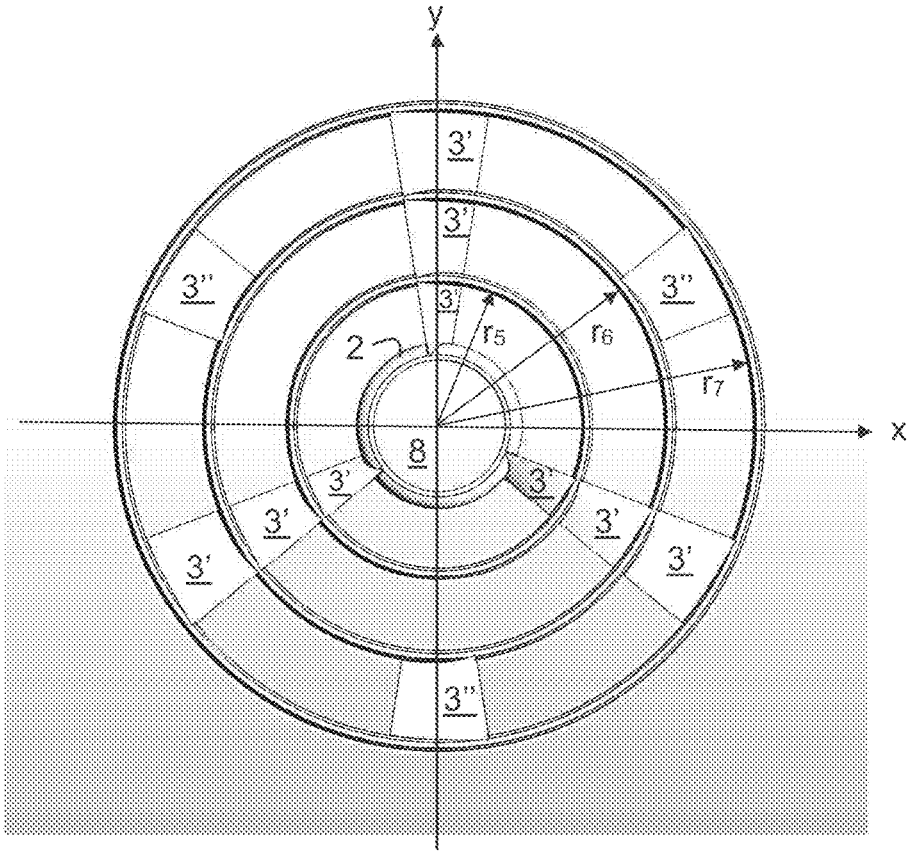
FIG. 3 shown a schematic pane view of the first embodiment of the sports shooting target according to the invention seen from above.

With reference to FIGS. 1, 2 and 3 there is shown a schematic representation of a sports shooting target (in the following simply referred to as a "target") according to an embodiment of the invention generally indicated by reference numeral 1.

The target is defined by a rotational or longitudinal axis (z) and extends generally in and adjacent to the (x, y) plane as shown in FIG. 1, in this embodiment, the target comprises three concentric ring members 5, 6, 7 encompassing a central hub portion 2 surrounding a central space 8. In this embodiment, the hub portion 2 has an inner circumferential surface 4" of such a shape that it fits to a corresponding portion of the launching head of a launching device that will be described in detail in the following.

Radially extending from the hub portion 2, the target comprises a plurality of trajectory stabilizing and propelling means that together with the ring members 5, 6 and 7 are configured to stabilize the trajectory of the target by gyro effect caused by rotation about said rotational axis z, which stabilizing means further act as propelling means that cause forward movement of the target along its trajectory due to the rotation of the target about the rotational axis z. In the embodiments of the target according to the invention shown in FIGS. 1, 2, 3, 5 and 9 the stabilizing and propelling means comprises a fan comprising fan blades 3', 3" that rotate in unison with the target, such that when the target rotates, the stabilizing and propelling means both provides the stabilizing gyro effect and the forward propulsion/motion of the target along a chosen trajectory.

The target according to the embodiments shown in FIGS. 1, 2 and 3 comprises a plurality of concentric ring members 5, 6, 7 arranged about the rotational axis z of the target at different distances $r_5$, $r_6$, $r_7$ (c.f. FIG. 3) from the rotational axis z and outside the hub portion 2. In FIGS. 1, 2 and 3, three such ring members are shown, but it is understood that other numbers of ring members could alternatively be used within the scope of the present invention.

In the embodiment shown in FIGS. 1, 2 and 3, the stabilizing and propelling means comprises three first fan blades (3') that extend radially from the hub portion 2 to the ring member 7 provided at the largest distance ($r_7$) from the rotational axis z as well as three second fan blades 7" that extend radially between the outermost two adjacent ring members 6 and 7. It is however understood that other numbers and placements of such fan blades would also fall within the scope of the present invention.

The prime effect of the first fan blades 3' is to propel the target, i.e. to move it along its trajectory after launching from the launching apparatus. The prime effect of the second fan blades 3" is to add strength and rigidity to the structure of the target at those portions of the target, where the centrifugal forces acting on the structure are the largest. The gyro stabilizing effect is obtained due to the rotation of the target about the rotational axis z in combination with the moment of inertia of the structure of the target. The presence of the ring members enhances visibility of the target, when it is moving along its trajectory through the air after being launched by the launching apparatus.

In FIG. 2, the interface 4'" between the blade and the corresponding rind shaped member is sharp, but in order to increase strength of the structure of the target, it is preferable that the intersection 4'" is thickened or rounded, In order to obtain the largest angular momentum—and hence the optimal gyro stabilizing effect—as much as possible of the total mass of the target should be concentrated furthest away from the rotational axis z of the target. This is according to the invention party obtained by the provision of the second fan blades 3" between the outermost two circular members 6 and 7.

According to the invention, the distance between adjacent ring members need not to be substantially identical as in the shown embodiments. In order to increase the moment of inertia and hence the gyro stabilizing effect, ring members may be placed closest to each other towards the outermost ring member.

In FIGS. 1, 2 and 3, the second fan blades 3" are shown positioned between the two ring members 7 and 6 furthest away from the hub portion of the target. It is however understood that the second fan blades 3" could alternatively be placed between other ring members.

Figure 4A:
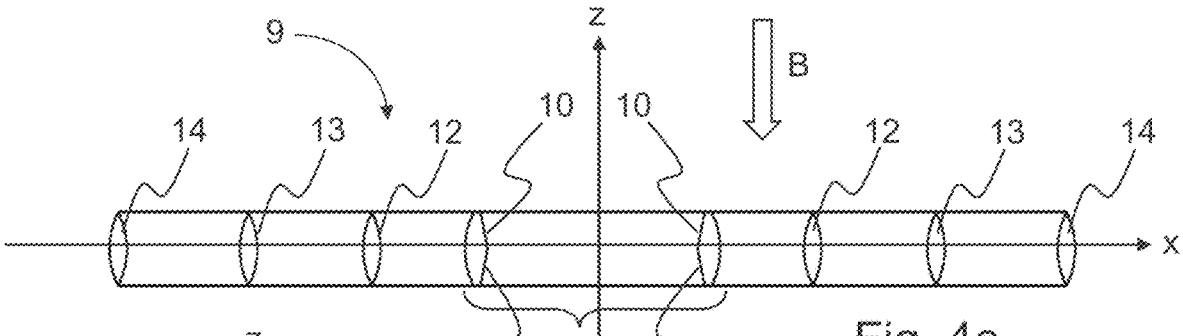
FIGS. 4*a* and 4*b* show a schematic cross-sectional side view of a second embodiment of the sports shooting target according to the invention.
Figure 4B:
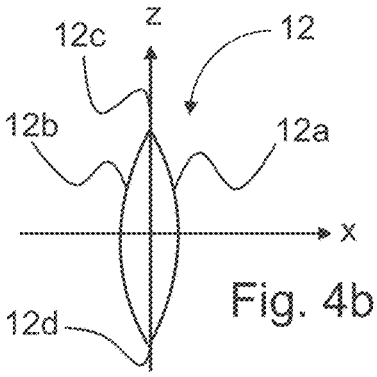
Figure 8:
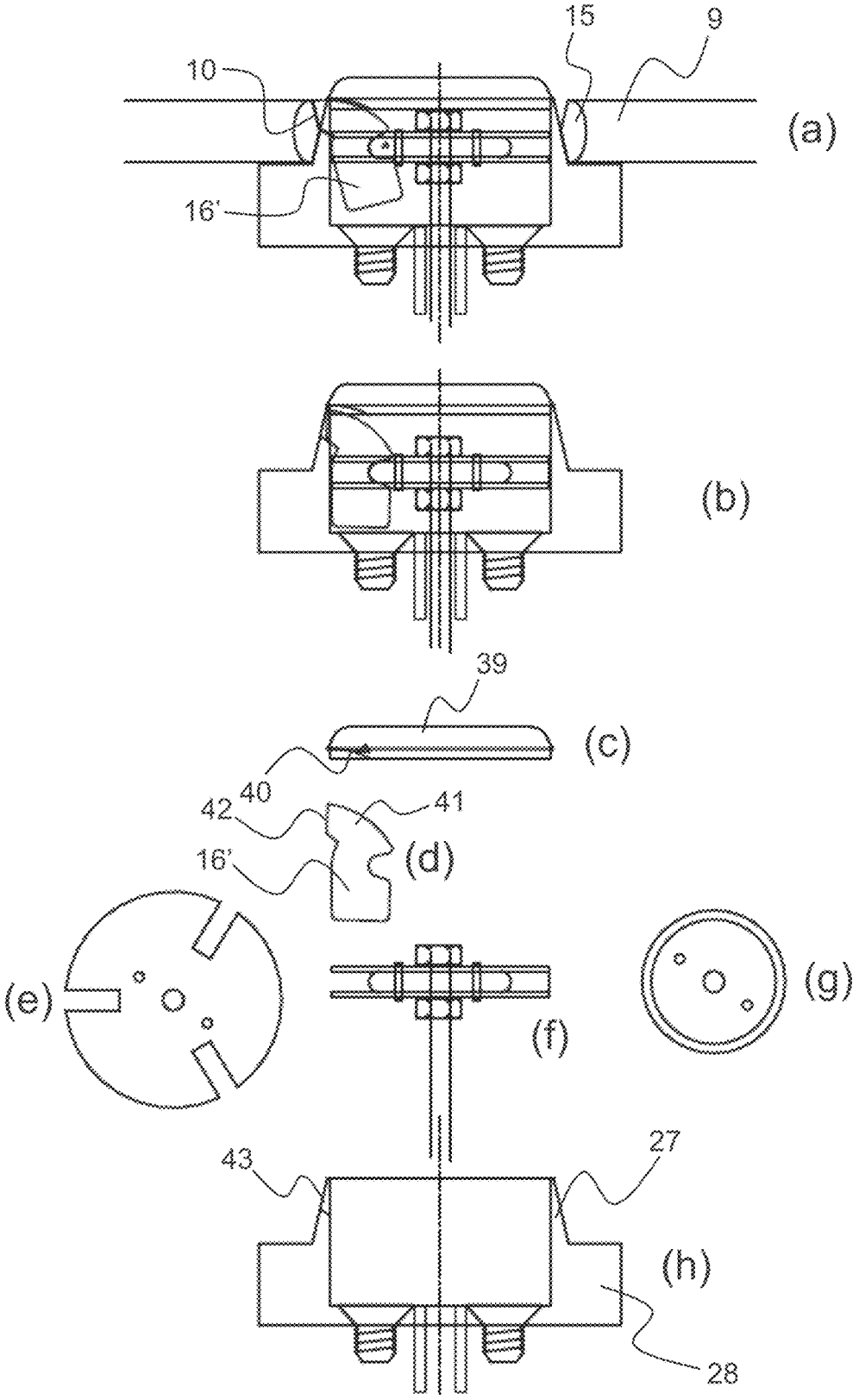
FIG. 8 shows a second embodiment of a launching head according to the invention configured to interact with the second and third embodiments of the target according to the invention shown in FIGS. 4 and 5.

With reference to FIGS. 4(*a*) and 4(*b*) there is shown a cross sectional view of a second embodiment of a target according to the present invention generally indicated by reference numeral 9. In contrast to the embodiment of the target shown in FIGS. 1, 2 and 3, the embodiment shown in FIG. 4 can be attached to the launching head of a launching apparatus from either side as indicated in FIG. 4 by the arrows B and C, which is a great advantage for instance when a plurality of targets are to be loaded into target containers on a launching apparatus. In the embodiment of the target shown in FIG. 4, the target comprises three concentric ring members 12, 13, 14 and a hub portion 15 provided with inwardly sloping surfaces 10 and 11 configured for releasable attachment to a corresponding portion of a launching head, c.f. FIG. 8. In the shown embodiment, the hub portion 15 is thus substantially symmetrical about the (x, y)-plane of the target. The inwardly sloping surfaces 10 and 11 converges towards the axis x, and are of similar extension and slope angle relative to the x axis, thereby it becomes possible to attach the hob portion of the target to the launching apparatus from either side as indicated by arrows B and C in FIG. 4*a*. By these features of the hub portion, a reversible or turnable target is presided.

In order to reduce resistance against the movement of the target along its trajectory by the air through which the target is moving, it is important to design the ring-shaped members 12, 13 and 14 (as well as those of the first embodiment designated be reference numerals 5, 6 and 7) optimally. It has been found that the cross-sectional shape shown in FIG. 4(*b*) yields a good result in that the ring-shaped members by having this cross-sectional shape only impedes the movement of the target along its trajectory minimally. In the shown embodiment, the ring-shaped members comprise curved first and second side faces 121 and 122, which side faces meet at either ends 123 and 124, respectively, in the z-direction, such that sharp edge portions at the upper and lower edges of the ring-shaped members are formed. The aero-dynamic properties of the ring-shaped members are good due to this shape of the ring-shaped members.

Figure 5:
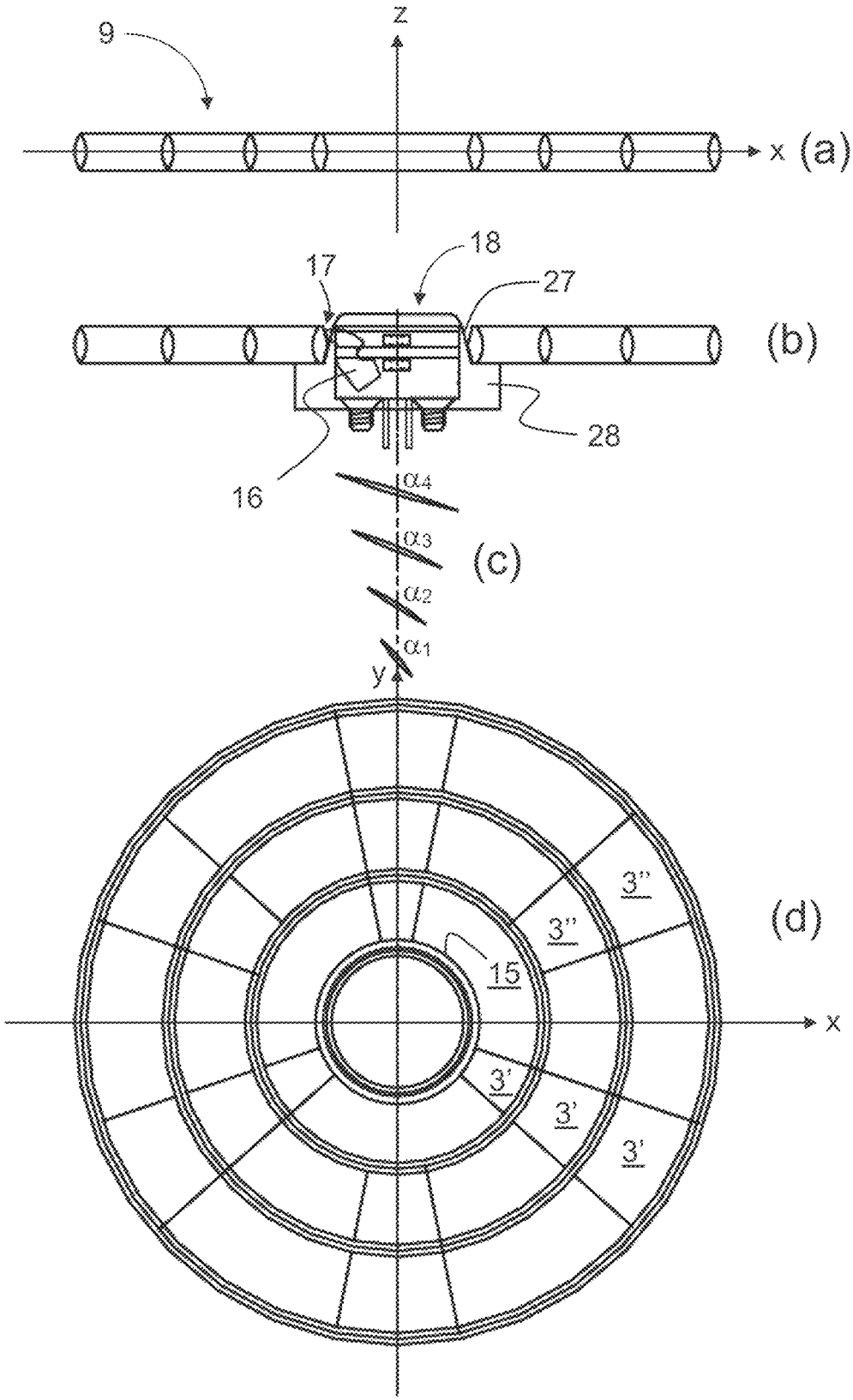
FIG. 5 shows a schematic view illustrating a third embodiment of the target according to the invention together with a corresponding launching head of a launching apparatus according to an embodiment of the invention.

With reference to FIG. 5 there is shown the second embodiment of the target according to the invention in some further detail together with its placement on a launching head according to an embodiment of the invention. FIG. 5(*a*) is similar to FIG. 4(*a*). FIG. 5(*b*) shows a simple schematic representation of this target placed on a correspondingly configurated launching head according to the invention that will be described in greater detail below.

The launching head basically comprises a body portion 28 with an inclined (conical) nose section 27 comprising an inclined (conical) circumferential outer surface, the inclination of which corresponds to the inclination of the inwardly sloping surfaces 10 and 11 of the hub portion 15 of the second embodiment 9 of the target. Pivotally mounted in the launching head are a plurality of restraining claw members 16 configured to retain the target to the launching head during the angular acceleration of the target prior to release from the launching head. The functioning of the launching head will be described in greater detail below in connection with FIGS. 6, 7 and 8.

FIGS. 5(*c*) and (*d*) describes further details of the second embodiment of a target according to the invention. FIG. 5(*c*) indicates that the inclination angle of the fan blades relative to the (x, y) plane of the target decreases from the hub portion 15 towards the outermost ring member 14 of the target. Further, in the embodiment of the target according to the invention shown in FIG. 5, second fan blades 3" extends between two adjacent ring members 12 and 13, and 13 and 14, respectively. Other configurations of fan blades are also within the scope of the invention, and one example is described below in connection with FIG. 8. The reduced inclination angle of the fan blades in the second embodiment of the target is also applied in the first embodiment of the target shown in FIGS. 1, 2 and 3. By decreasing the inclination angle of the fan blades towards the outer ring member it is obtained that substantially the same amount of air is displaced by the fan blades at any distance from the hub portion.

Figure 6:
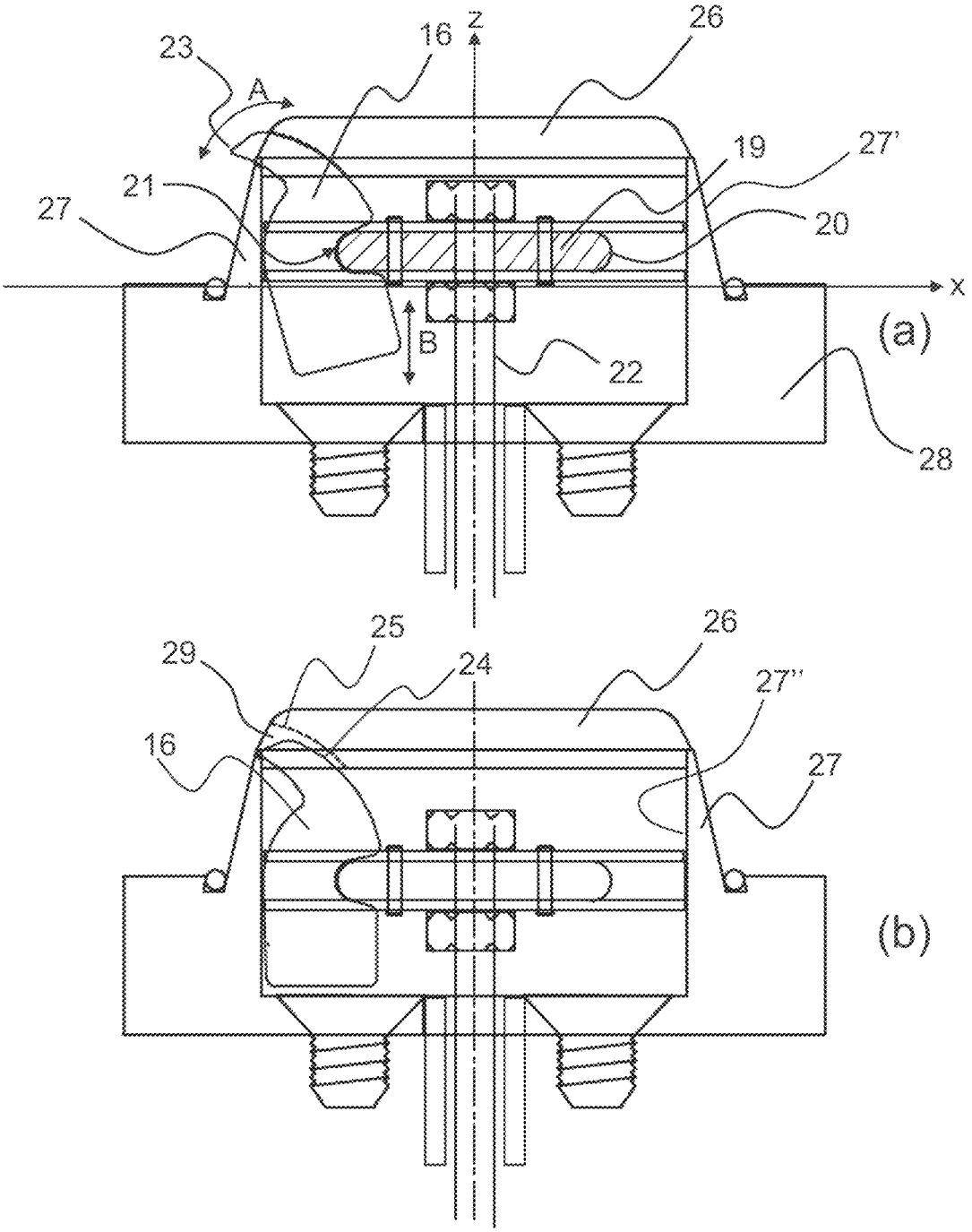
FIG. 6 shows a launching head according to an embodiment of the invention configured to interact with the sports shooting target according to the first and second embodiments of targets shown in FIGS. 1, 2 and 3.
Figure 7:
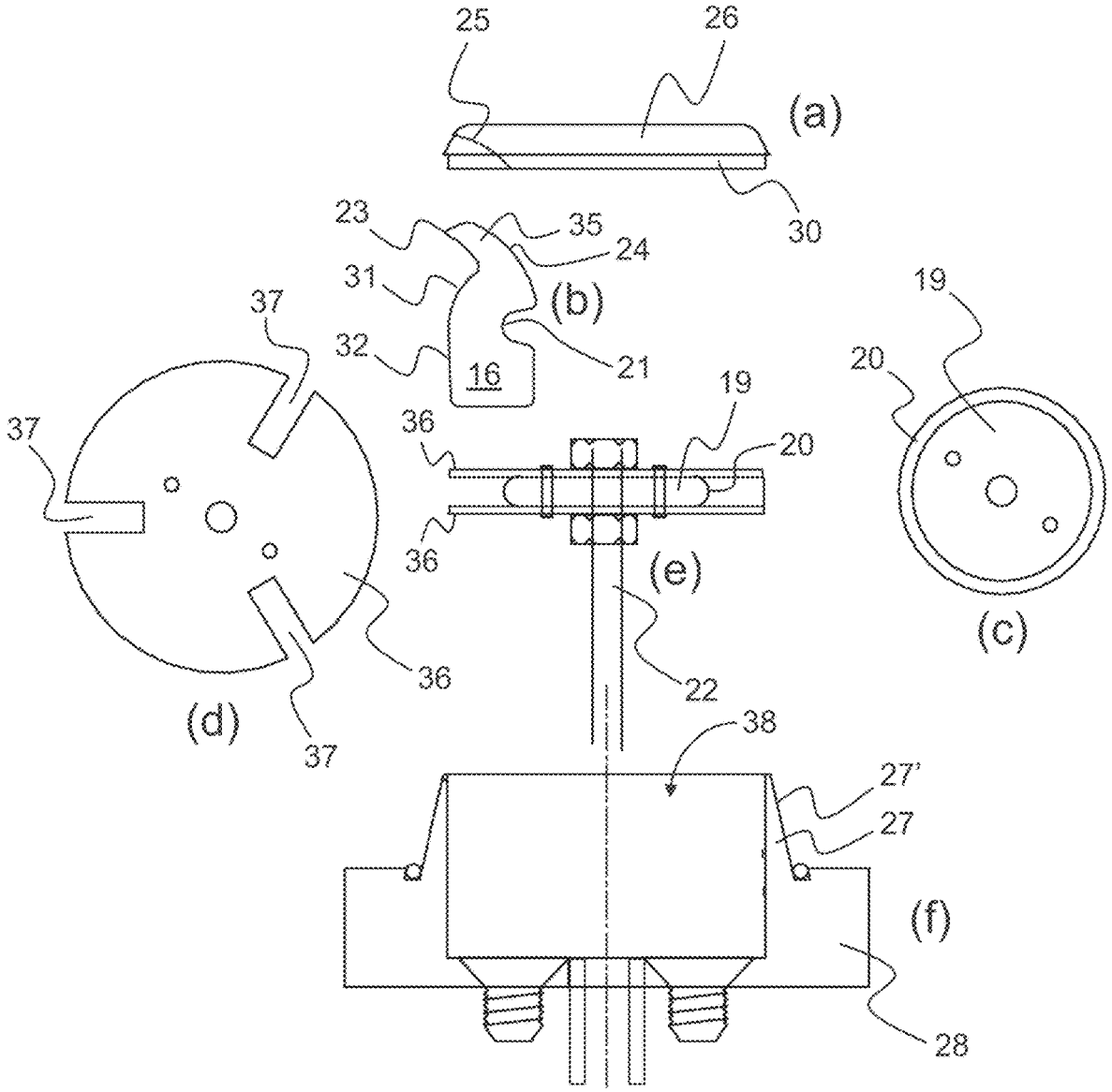
FIG. 7 shows schematic views of the various man parts of the launching head shown in FIG. 6.

With reference to FIGS. 6, 7 and 8 there are described two different embodiments of a launching head configured to cooperate with the target according to the invention. The first embodiment that is described in FIGS. 6 and 7 is configured for launching the embodiment of the target shown in FIGS. 1, 2 and 3 and the second embodiment of the launching head shown in FIG. 8 is configured for launching the embodiment of the target shown in FIGS. 4 and 5.

The launching head shown in FIGS. 6(*a*) and (*b*) comprises a body part 28 configured for attachment to a launching apparatus to be described in the following, which body part 28 comprises a nose section 27 having a conical outer circumferential surface 27' configured to correspond to the inner circumferential surface of the hub of the target. At the top, the launching head is terminated by a cab member 26.

In the cab member 26 there are provided a plurality of channels 29 having inwardly extending circumferential curved channel surfaces 25, the curvature of which corresponds substantially to the curvature of the curved portion 24 of the upper portion 35 of the claw member 16 as shown in FIG. 7.

At certain angular intervals about the z-axis (the rotational axis), the launching head is provided with restraining claw members 16 mounted such that they can undergo a pivotal movement in the launching head as indicated by arrow A in FIG. 6(*a*). Thus, the claw members 16 can pivot between a radially extended position of the upper portion 35 of the claw member 16 (see FIG. 7(*b*)) as shown in FIG. 6(*a*), where they hold the target in firm connection with the launching head, and a radially retracted position of the upper portion 35 of the claw member 16 as shown in FIG. 6(*b*), where they release the target from the launching head.

The pivotal movement of the claw members 16 is obtained by longitudinal displacement of the shaft 22 as indicated by arrow Bin FIG. 6(*a*). At one longitudinal end of the shaft 22 there is attached a disc-shaped member 19 radially terminated by a rounded circumferential side portion 20. This side portion 20 is in engagement with a similarly shaped portion 21 of the claw member 16 and when the shaft 22 is longitudinally displaced (arrow B), the claw member 16 will undergo the pivotal movement depicted in FIGS. 6(*a*) and 6(*b*). Specifically, when the claw member 16 is in the retracted position shown in FIG. 6(*b*) and the shaft 22 is displaced upwards (in the positive z-direction), the curved portion 24 of the claw member 16 will get in contact with the similarly curved inner surface 25 of the channel 29 in the launching head, and the claw member 16 will be forced radially outward into the extended position shown in FIG. 6(*a*). During this pivotal movement of the claw member 16, the claw member will pivot around the curved portion 31 (see FIG. 7) that is in contact with the inner portion 27 of the nose section 27 of the launching head.

With reference to FIG. 7 there is shown the main components of the launching head according to the embodiment shown in FIG. 6. FIG. 7(*a*) shows a side view of the cab 26, and one of the channels 25 accommodating the top portions 23, 35 of the claw members 16 is indicated in broken line. The cab comprises a base portion 30 formed for insertion into the inner cavity 38 of the nose section 27 of the launching head.

FIG. 7(*b*) shows the claw member 16 used in this embodiment of the launching head. The claw member 16 comprises: an upper section 35 provided with a pointed end portion 23. A lower section 32 of the claw member 16 is connected to the upper section 35 via an intermediate portion with a curved outer portion 31 and a recess 21 formed for engagement with the rounded side portions 20 of the disc-shaped member 19 attached to the shaft 22.

As shown in FIGS. 7(*c*), (*d*) and (*e*), two thin guide disc 36 provided with recesses 37 formed to accommodate the respective claw members 16 is placed on either, opposite longitudinal faces of the disc-shaped member 19. The guide discs 36 and the disc-shaped member 19 are fixedly attached to the shaft 22.

FIG. 7(*f*) shows schematically the body part 28 of the launching head comprising the nose section 27 with the conical outer circumferential surface 27'. An inner cavity 38 is defined by the body portion to accommodate the various elements described in FIGS. 7(*a*) through 7(*e*).

With reference to FIG. 8 there is shown a second embodiment of a launching head according to the invention configured to interact with the second and third embodiments of the target according to the invention shown in FIGS. 4 and 5. The second embodiment of the launching head corresponds basically to the first embodiment hereof except for the configuration of the claw members 16' that comprise a side portion 42 configured to correspond to the inclined portions 10 or 11 of the embodiment of the target shown in FIGS. 4 and 5. In the cab 39, first channels portions 40 are formed corresponding to the positions of the claw members 16' and second channel portions 43 are also provided in the body part 28 at positions corresponding to those of the first channel portions 40.

Throughout the description, three claw members 16, 16' are shown, but it is understood that other numbers of claw members could be used without departing from the scope of the invention.

Figure 9:
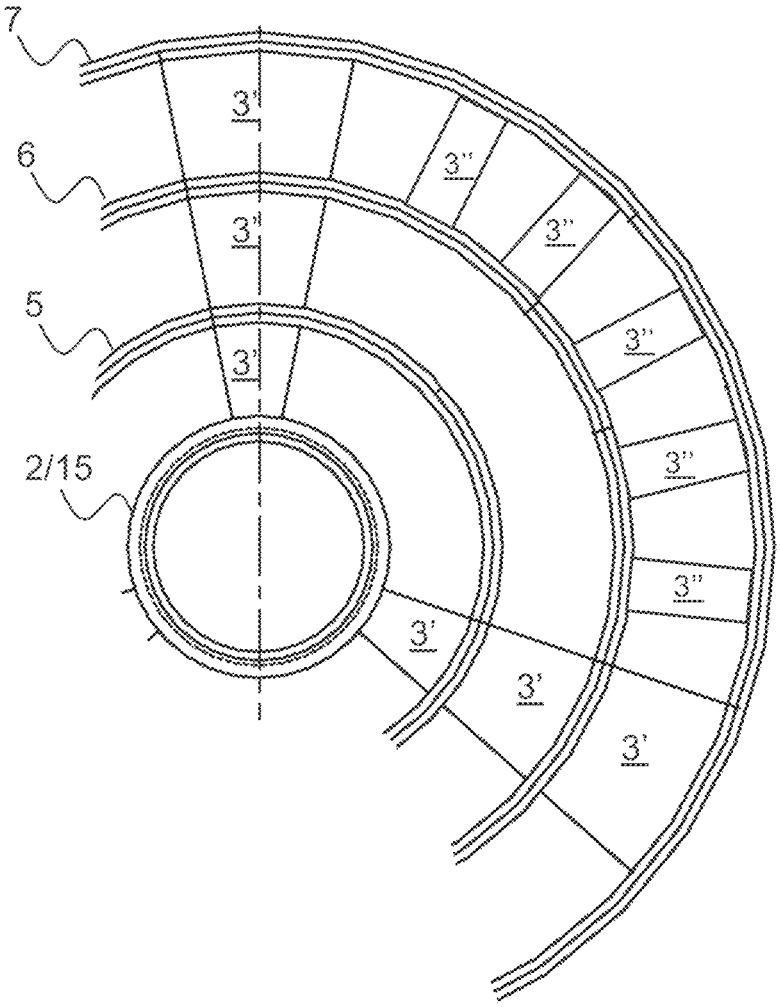
FIG. 9 shows a schematic plane view of a portion of a target according to a fourth embodiment of the target according to the invention.

With reference to FIG. 9 there is shown a schematic plane view of a portion of a target according to a fourth embodiment of the target according to the invention. In this embodiment, a plurality of second fan blades 3" are provided between the outermost ring member 7 and the adjacent ring member 6. It is however noted that the number and positioning of the second fan blades 3"—and also between which of the ring members they are inserted—can be chosen as desired, without departing from the scope of the invention.

Figure 10:
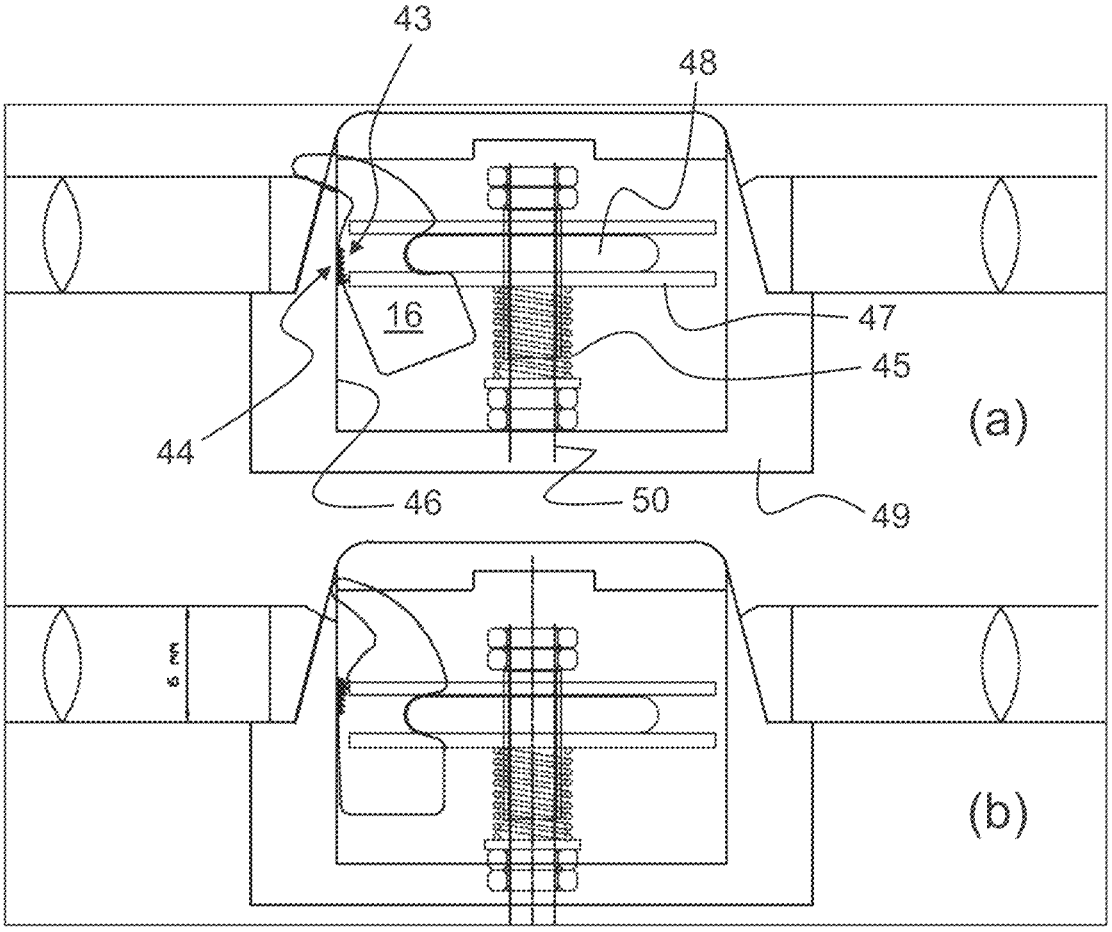
FIG. 10 shows a schematic representation of a second embodiment of a launching head according to the invention.

With reference to FIG. 10 there is shown a schematic representation of a second embodiment of a launching head according to the invention. The launching head according to this embodiment is configured to launch a target according to the first embodiment shown in FIGS. 1, 2 and 3, but it is understood that the features specifically described in this launching head and that are added to those of the first embodiment of a launching head could also be incorporated in a launching head configured to launch a target according to the second embodiment shown in FIGS. 4 and 5.

The second embodiment shown in FIG. 10 differs from the first embodiment of the launching head in that the retaining claw members 16 are provided with a toothed section 43 in the curved portion 31 configured to engage with a corresponding toothed section 44 on the inner wall 46 of the body pad 49 of the launching head. Furthermore, between the disc shaped member 47 provided on the lower face of the disc-shaped member 48 and the body part 49 of the launching head there is provided a spring member 45 that forces the disc shaped members 47 and 48 upwards towards the retaining state of the claw member 16 as shown in FIG. 10(*a*). In FIG. 10(*b*), the shaft 50 has drawn the claw member 16 into the state in which the target is released from the launching head.

The launching head according to the invention can be used in many differently designed launching apparatuses. In the following some such apparatuses are briefly described, but many other configurations of such apparatuses could be used together with the launching head of the invention to launch targets according to the invention. Basic requirements for such launching apparatuses are that they are provided with means configured to (1) rotate the Launching head, and hence the target attached hereto, about the rotational axis z of the launching head/target, thereby increasing the rotational speed of the launching head and target from zero to a maximum rotational speed that typically will be in the order of 15.000 to 20.000 rpm; and (2) to provide the longitudinal displacements of the shaft 22 (or similar means) that are required to bring the claw members 16, 16' from a state, in which they retain the target to the launching head to a state, in which they release the target from the launching head and vice versa. A suitable launching apparatus should also preferably be provided with means for monitoring the rotational speed of the launching head and target and, when the desired maximum rotational speed is obtained, to operate the claw members to release the target from the launching head.

Figure 11:
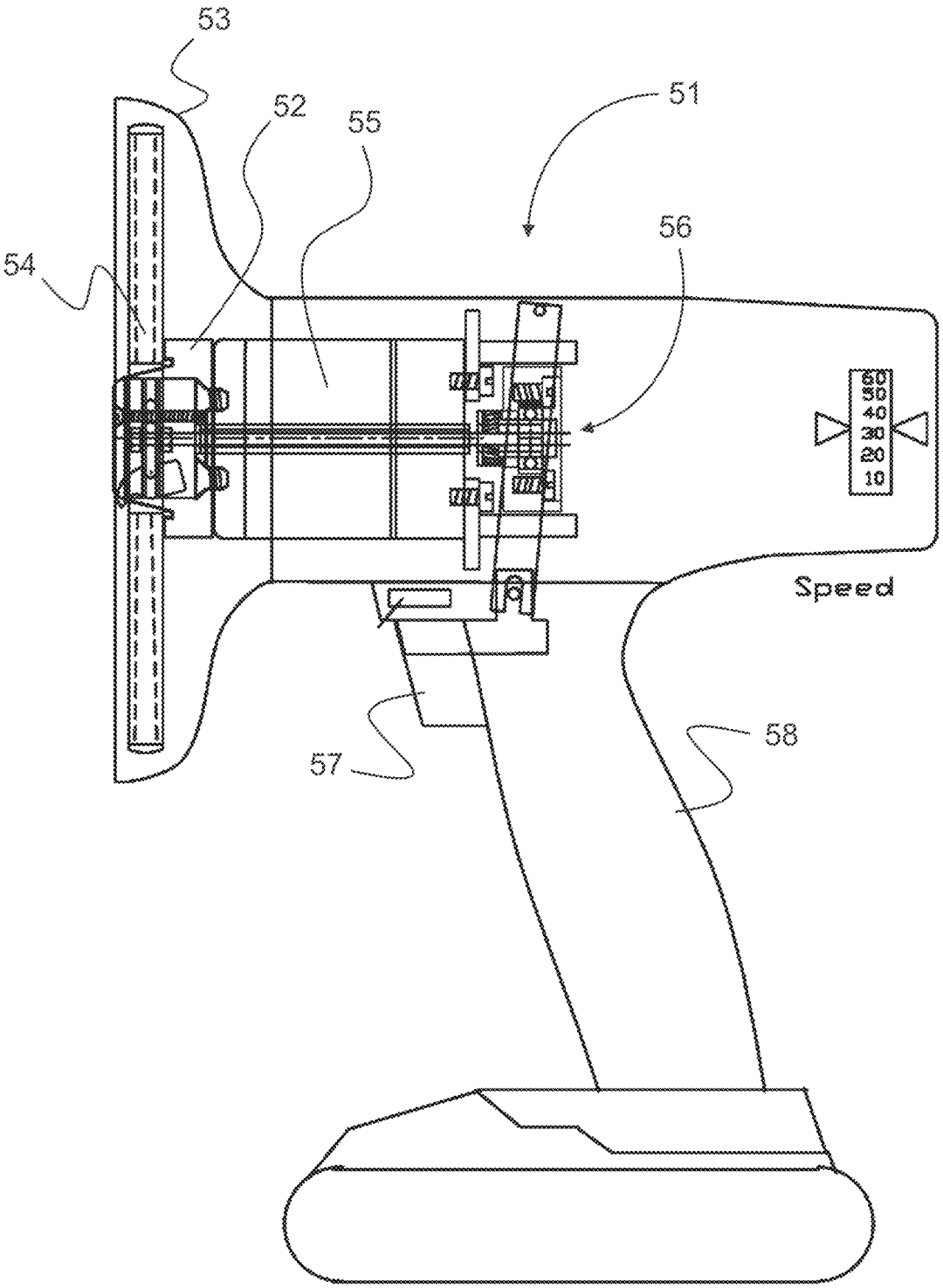
FIG. 11 shows a schematic side view of hand-held version of a launching device according to the invention.

With reference to FIG. 11 there is shown a schematic side view of a hand-held version of a launching apparatus according to the invention generally indicated by reference numeral 51. The hand-held launching apparatus basically comprises a launching head 52 as described above mounted within a protecting screen 53 that encompasses the target 54 and that during use protects the user against the rapidly rotating target. The launching head is in this embodiment mounted directly on the drive shaft of the drive motor 55, which drive shaft is hollow such that the longitudinal shaft that operated the retaining craw members in the launching head is passed through the hollow drive shaft of the motor 55. Longitudinally opposite the launching head 52 there is provided a mechanism 56 configured to displace the longitudinal shaft that operated the retaining claw members as described in the preceding paragraphs. This mechanism 56 is coupled to the trigger 57 that the user operates in order to open and close the retaining claw members in the launching head 52. The apparatus is provided with a handle portion 58.

Figure 12:
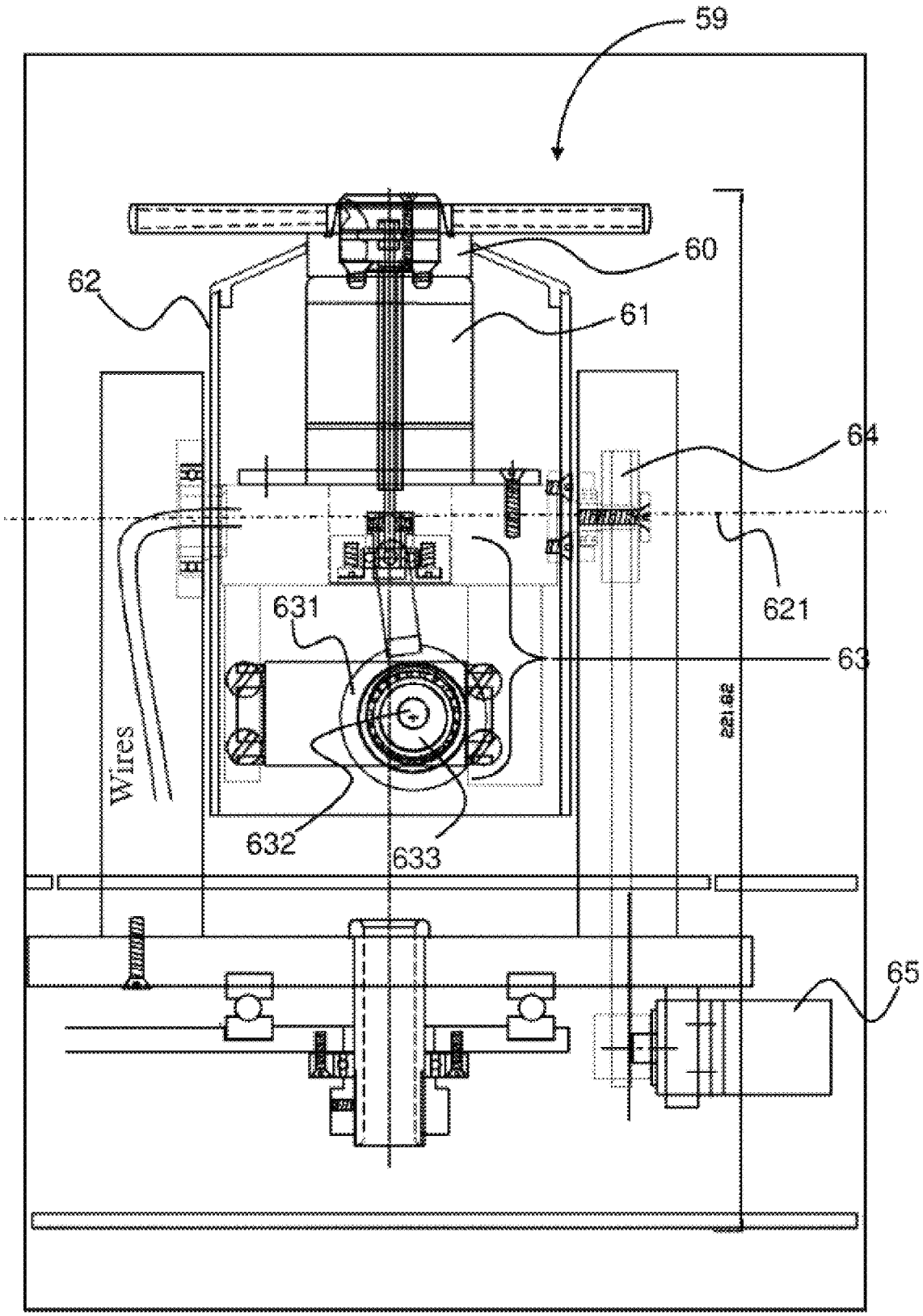
FIG. 12 shows a schematic view of a first embodiment of a launching apparatus comprising operating means configured to operate the launching head between a state, in which the target is attached to the launching head and a state, in which the target I released from the launching head.

With reference to FIG. 12 there is shown a schematic view of a first embodiment of a launching apparatus generally indicated by reference numeral 59 comprising operating means configured to operate the launching head between a state, in which the target is attached to the launching head and a state, in which the target is released from the launching head.

The apparatus shown in FIG. 12 basically comprises the launching head 60 provided on the drive motor 61 configured to rotate the launching head 60, and the displacement mechanism 63 that operates the longitudinal shaft operating the claw members in the launching head. In this embodiment, the displacement mechanism 63 is an electro-mechanical mechanism comprising a motor means 631 upon the drive shalt 632 of which there is provided an eccentric member 633 that converts the rotational movement of the drive shaft 632 to the desired displacement of the longitudinal shaft that operated the claw members in the launching head. The launching head 60, the motor 61 and the operating mechanism 63 are accommodated within a common housing 62 that is pivotally mounted about a pivot axis 621 such that a pivot motor 65 can pivot the housing 62 about the axis 621 as indicated schematically by 64 and thereby determine the elevation angle, at which the target leaves the launching apparatus, when the target is released from the launching head.

Figure 13:
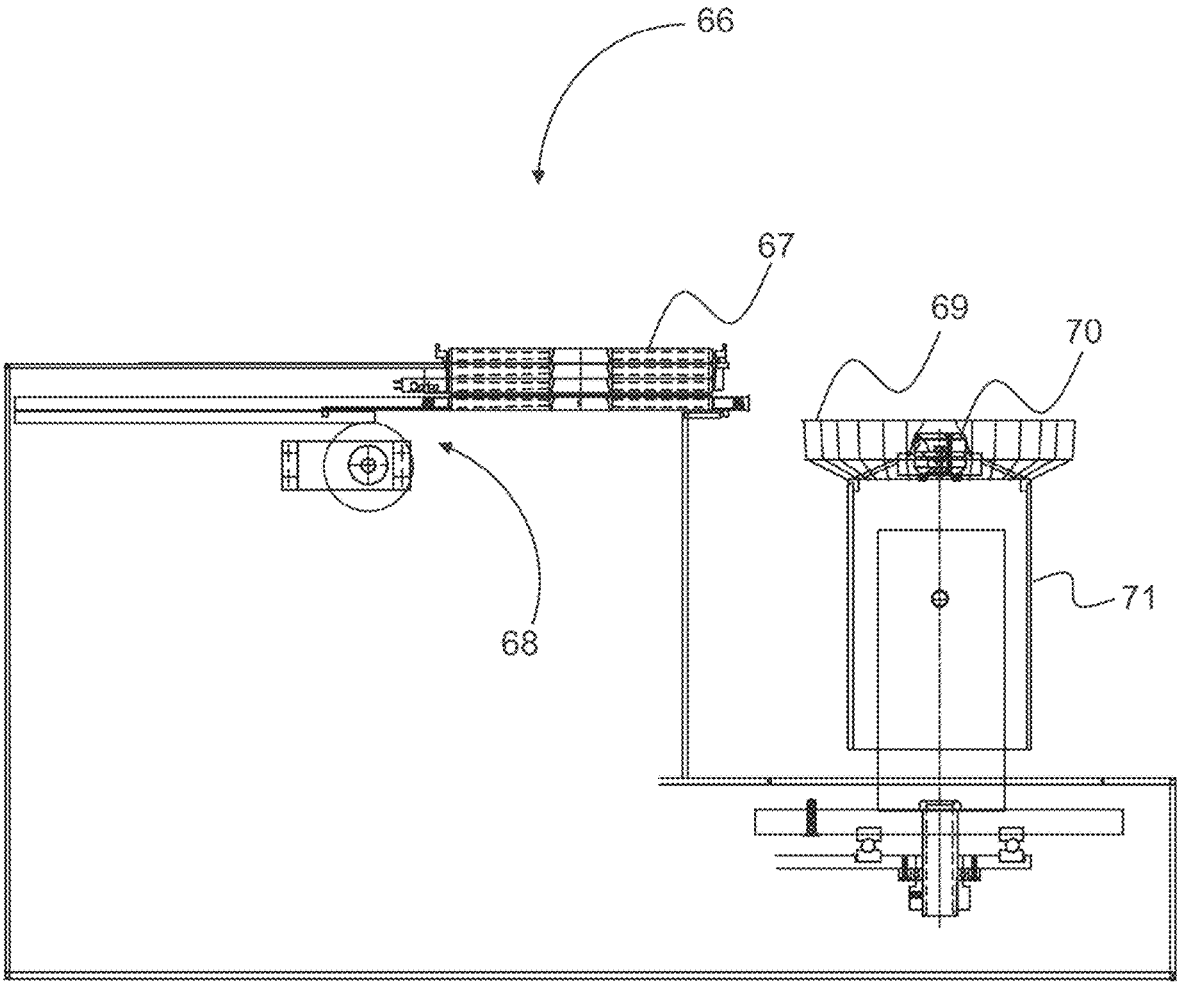
FIG. 13 shows a schematic side view of a launching apparatus according to an embodiment of the invention.

With reference to FIG. 13 there is shown a schematic side view of a launching apparatus according to an embodiment of the invention generally indicated by reference numeral 66. The figure shows the launching head 70 mounted at one longitudinal end of the housing 71 that contains the rotational and operational means required for operating the launching head (such as, but not limited to, those described above). The apparatus can support a stack 67 of targets and a loading mechanism 68 loads one target at a time into a position directly above (as seen in the figure) the launching head and then releases the target downwardly onto the launching head. The launching head is surrounded by a protective screen 69 as also mentioned in connection with the hand-held apparatus described above.

Figure 14:
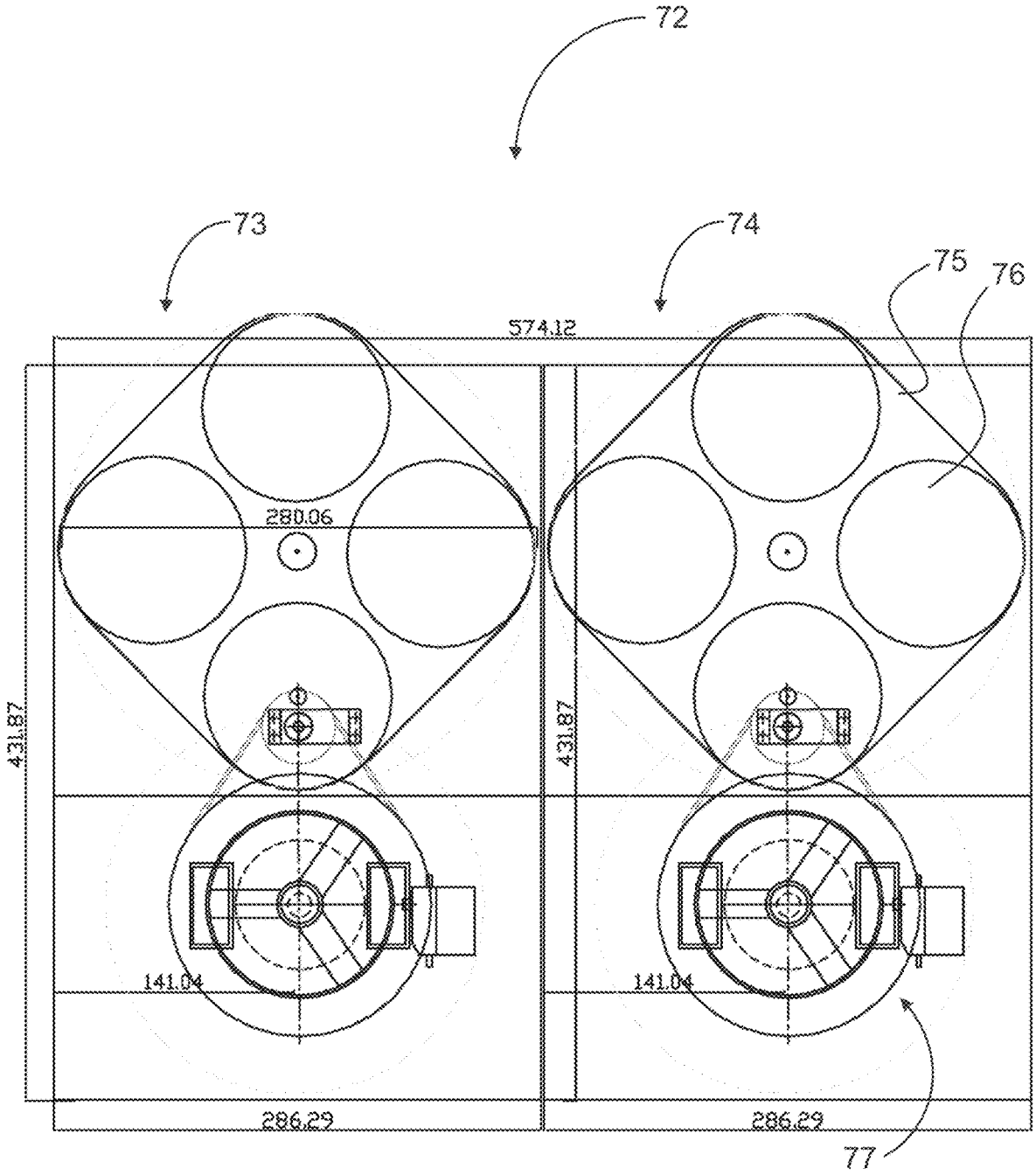
FIG. 14 shows a schematic representation of a top view of an embodiment of a launching apparatus according to the invention.

With reference to FIG. 14 there is shown a schematic representation of a top view of an embodiment of a launching apparatus according to the invention generally indicated by reference numeral 72. This embodiment of the apparatus according to the invention comprises two separate sections 73 and 74, each provided with four containers 76 provided on a rotatable structure 75. When a target is provided on one of the launching heads 77 of one section 74 and accelerated to obtain the desired maximum rotational speed at which it can be released form the launching head, a loading process is performed at the other section 73, thereby increasing the rate at which targets can be launched from the apparatus.

The following FIGS. 15 through 19 discloses various electro-magnetic mechanisms that can be applied according to the invention to provide the necessary longitudinal displacement of the shaft that operates the retaining claw members 16, 16' as well as the rotational movement of the launching head. It is however emphasized that the shown embodiments are only examples of such mechanisms, and that other mechanisms having a similar effect may be used in the launching apparatus according to the invention. In FIGS. 15 through 19, only the basic functional elements of the respective mechanisms configured to operate the retaining claw members are described.

Figure 15:
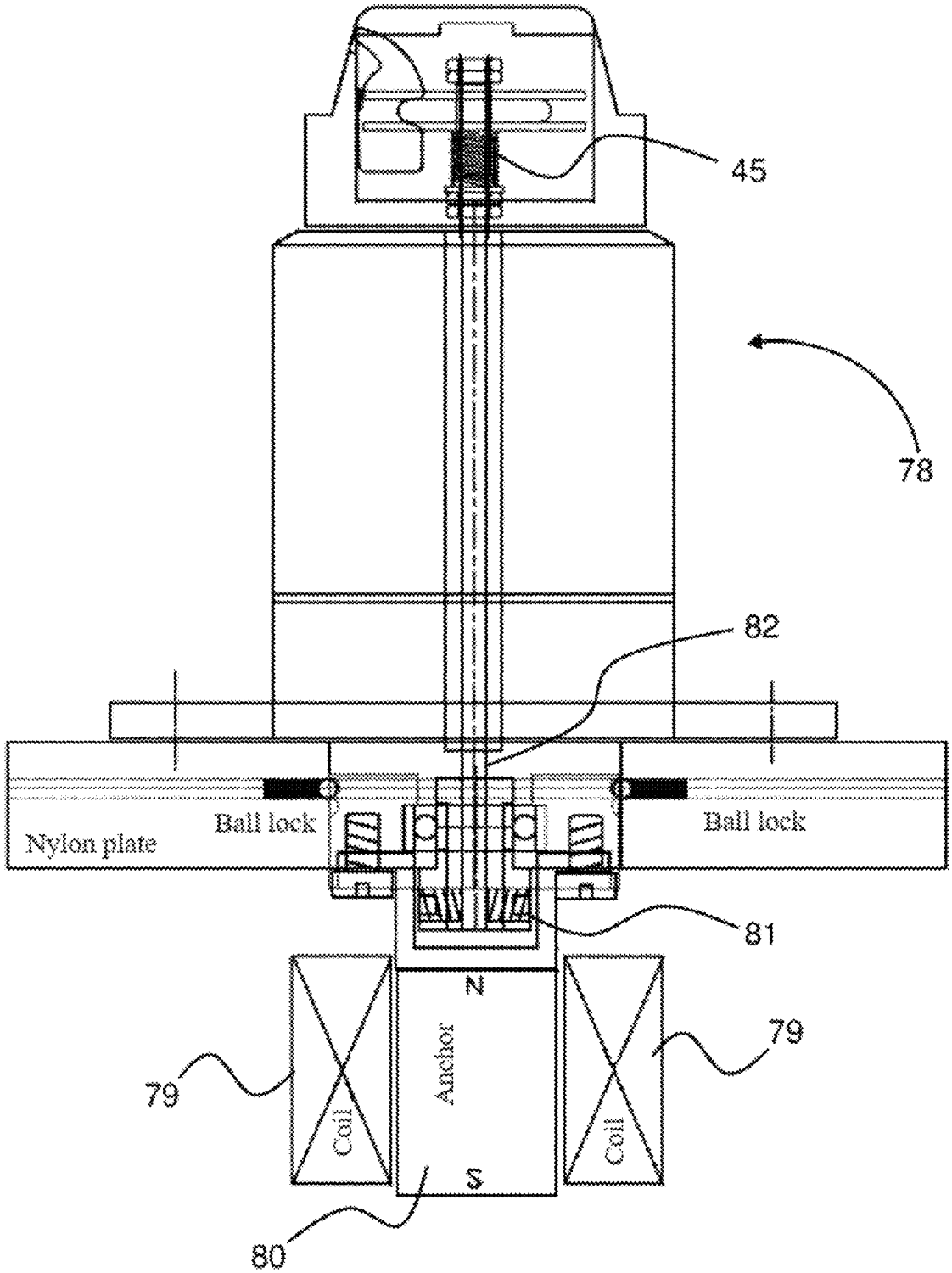
FIG. 15 shows a schematic view of a second embodiment of operating means configured to operate the launching head between a state, in which the target is attached to the launching head and a state, in which the target I released from the launching head.

With reference to FIG. 15 there is shown a schematic view of a second embodiment of a launching apparatus generally indicated by reference numeral 78. The shaft 82 that operates the claw members is at the longitudinal end opposite the launching head provided with a body 81 that can be attracted by a magnetic force. Below the body 81 (as seen in FIG. 15) there is provided electro-magnetic structure comprising a ring coil 79 surrounding an anchor member 80. When an electric current is passed through the coil 79, the anchor 80 attracts the body 81 and hence displaces the shaft 82 against the force exerted by the spring 45. When the electric current is turned off, the spring forces the shaft 82 back to its upper position in which the claw members retain a target to the launching head.

Figure 16:
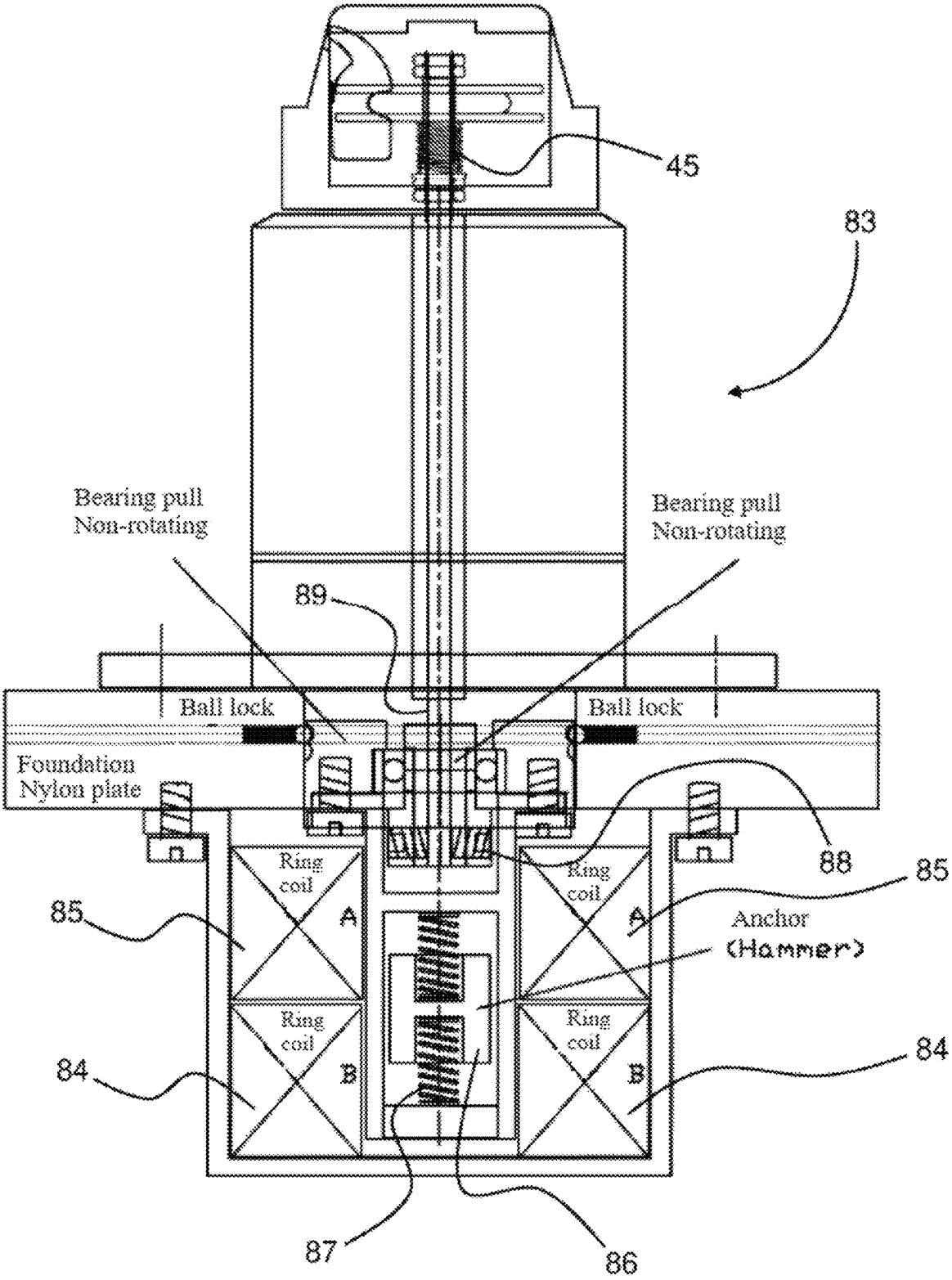
FIG. 16 shows a schematic view of a third embodiment of operating means configured to operate the launching head between a state, in which the target is attached to the launching head and a state, in which the target I released from the launching head.

With reference to FIG. 16 there is shown a schematic view of a third embodiment of a launching apparatus generally indicated by reference numeral 83. This embodiment comprises two ring cols 84 and 85 surrounding, a displaceable anchor (or "hammer") longitudinally displaceably mounted within the coils and loaded on either longitudinal side of the anchor by a spring 87.

Figure 17:
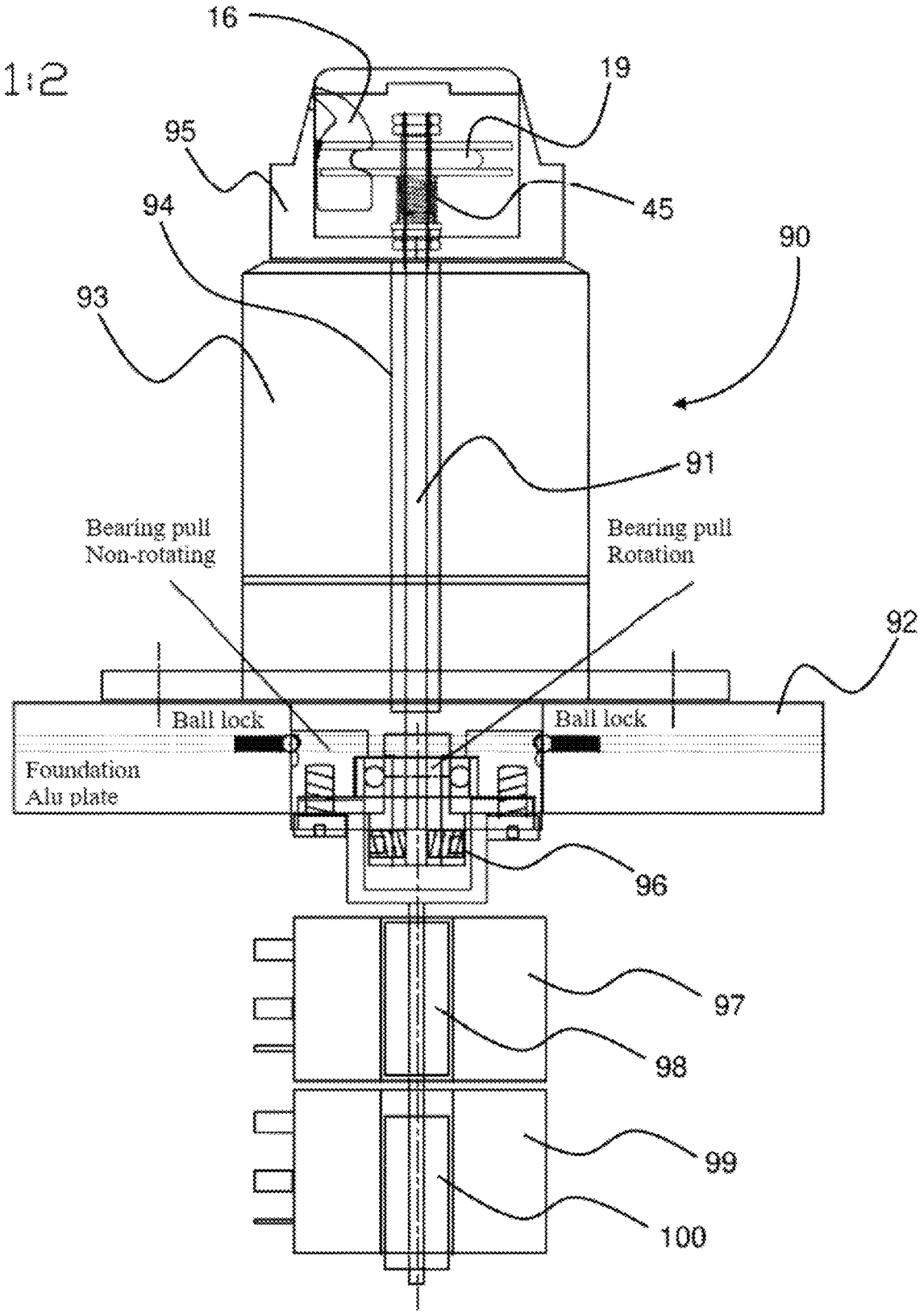
FIG. 17 shows a schematic view of a fourth embodiment of operating means configured to operate the launching head between a state, in which the target is attached to the launching head and a state, in which the target released from the launching head.

With reference to FIG. 17 there is shown a fourth embodiment of operating means configured to operate the launching head generally indicated by reference numeral 90 between a state, in which the target is attached to the launching head and a state, in which the target I released from the launching head. The launching head is provided with caw members 16, a disc-shaped body 19 and a spring 45 as described above. The claw members are operated by means of a longitudinal displacement of the shaft member 91 as also described previously. The launching head 95 is fixedly provided on a hollow longitudinally extending driving shaft 94 of a motor 93 that rotates the launching head. Through the hollow shaft 94 of the motor 93 there is passed the operating shaft 91 of the claw members. The motors fixed to a base plate 92 that is attached to a portion of the launching apparatus. A claw member operating bearing 96 of a material that can be attracted by a magnetic field is fixedly provided at the lower (as seen in the figures) longitudinal end of the shaft member 91.

The claw member operating bearing 96, and hence the shaft member 91, will undergo longitudinal displacement when acted upon by a magnetic field of appropriate strength and direction. This magnetic field is provided by the coils 97 and 99 via the respective anchors 98 and 100 that are displaceably mounted on a longitudinal rod through the coils 97 and 99, which rod is in fixed relationship to the base plate 92. The functional effect of this embodiment will be described below with reference to FIGS. 19(*a*) and 19(*b*).

Figure 18:
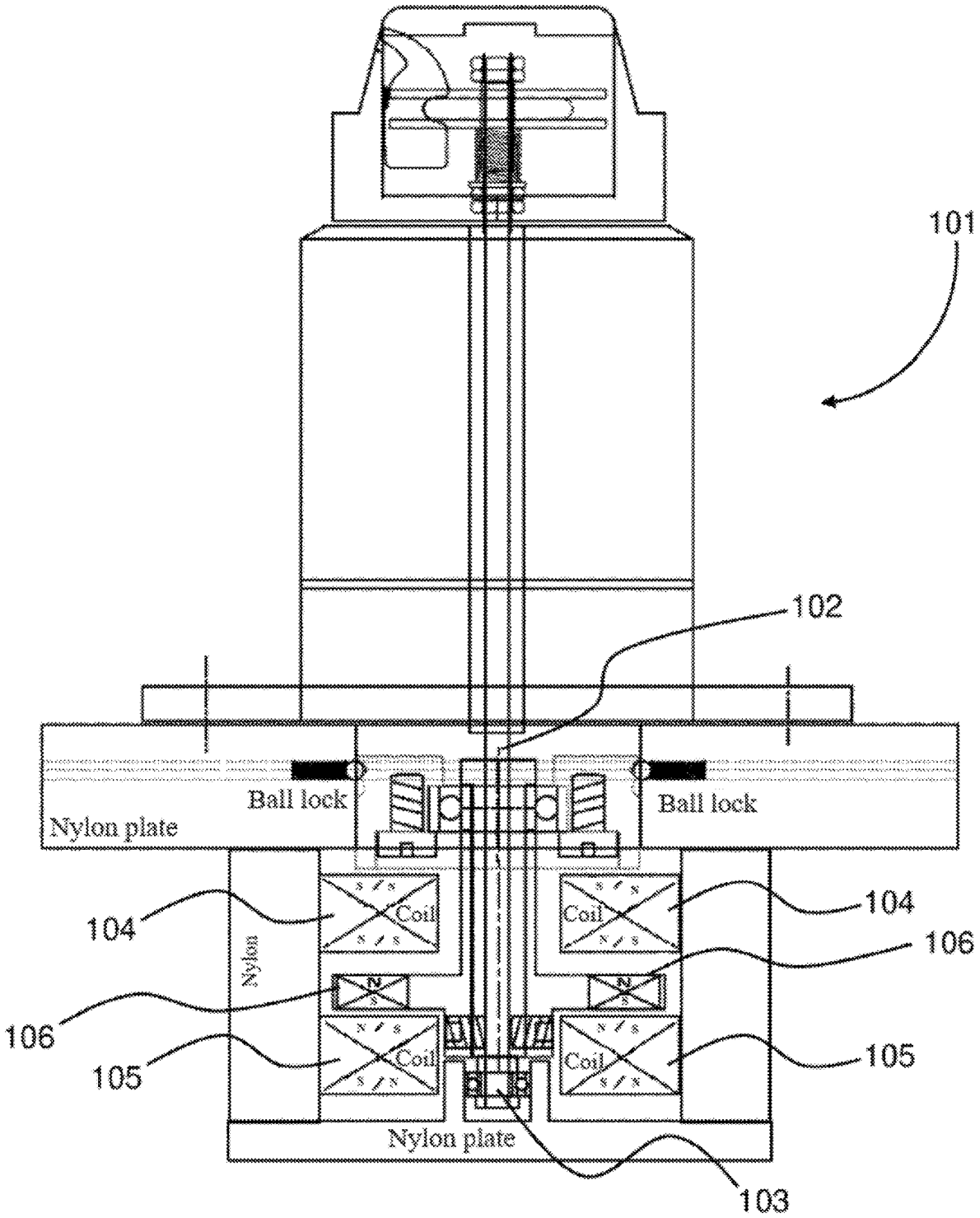
FIG. 18 shows a schematic view of a fifth embodiment of operating means configured to operate the launching head between a state, in which the target is attached to the launching head and a state, in which the target released from the launching head.

With reference to FIG. 18 there is shown a schematic view of a fifth embodiment of operating means generally indicated by reference numeral 101 configured to operate the launching head between a state, in which the target is attached to the launching head and a state, in which the target I released from the launching head. This embodiment differs basically from the other described electro-magnetic embodiments in that a permanent ring-shaped magnet 106 is attached to the claw member operating shaft 102 longitudinally between a first ring coil 104 and a second ring coil 105. Dependent on the direction and strength of an electric current passed through the two ring coils, the permanent magnet 106 and hence the shaft 102 will be displaced in an upward or downward direction (as seen in the figure).

Figure 19A:
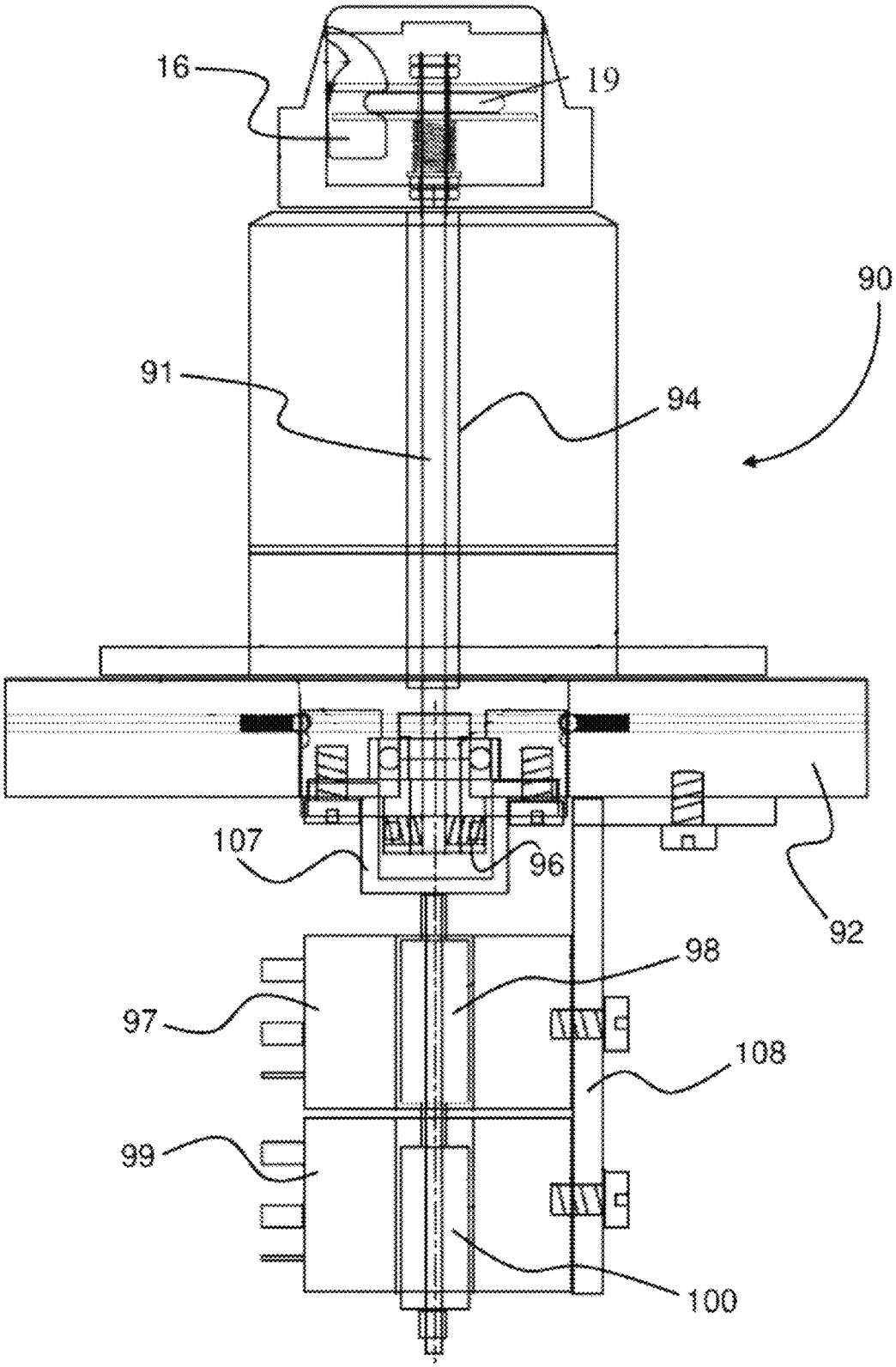
FIGS. 19(*a*) and 19(*b*) shows a schematic view of a fourth embodiment shown in FIG. 17 embodiment of operating means configured to operate the launching head between a state, in which the target is attached to the launching head and a state, in which the target I released from the launching head, shown in the two states of the operation means.
Figure 19B:
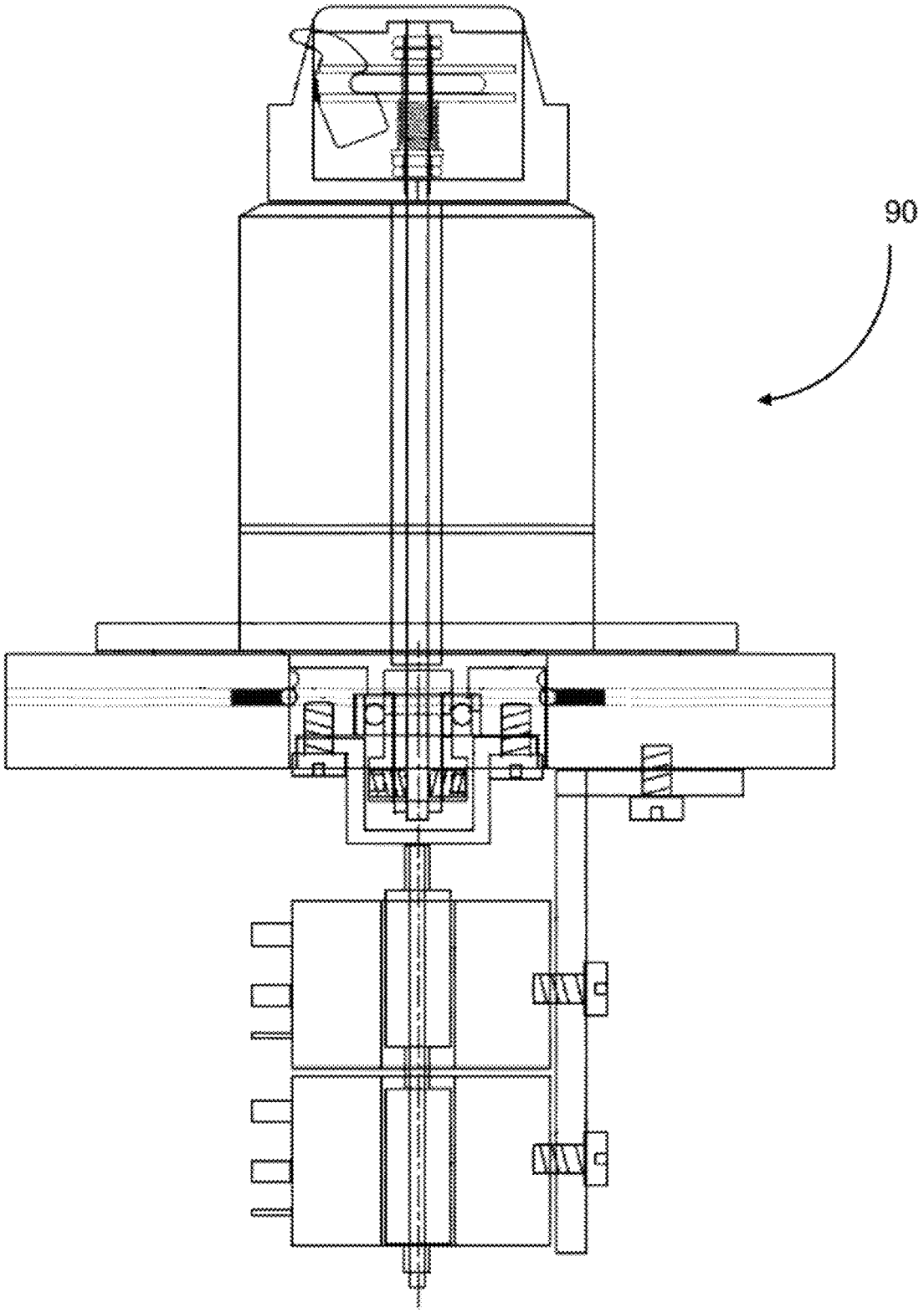

With referee to FIGS. 19(*a*) and 19(*b*) there are shown a schematic view of the fourth embodiment shown in FIG. 17 of operating means configured to operate the launching head between a state, in which the target is attached to the launching head and a state, in which the target I released from the launching head. FIG. 19(*a*) shows the state in which the claw members are in the retracted position, in which the target is free to leave the launching head and FIG. 19(*b*) shows the state in which the claw members are in the radially outward extended position, in which the target is fixed to the launching head.

The two anchors 98 and 100 in the respective ring coils 97 and 99 are attached to the bracket member 107 and via this to the base plate 92. Likewise, the two ring coils 97 and 99 respectively are attached via the bracket 108 to the base plate 92. When an electric current is applied to coil 97, the claw member operating bearing 96 will be displaced downwardly (as seen in FIG. 19(*a*)) with the effect that the claw members 16 will be drawn into the launching head for release of the target from the launching head. When an electric current is applied to coil 99, the claw member operating bearing 96 will be displaced upwardly (as seen in FIG. 19(*b*)) with the effect that the claw members 16 will be radially extended from the surface of the launching head and thereby retain the target to the launching head.

Preferably, electric current should only be applied to the two coils 97 and 99 as briefly as possible in order to limit the current supply as much as possible.

Figure 20:
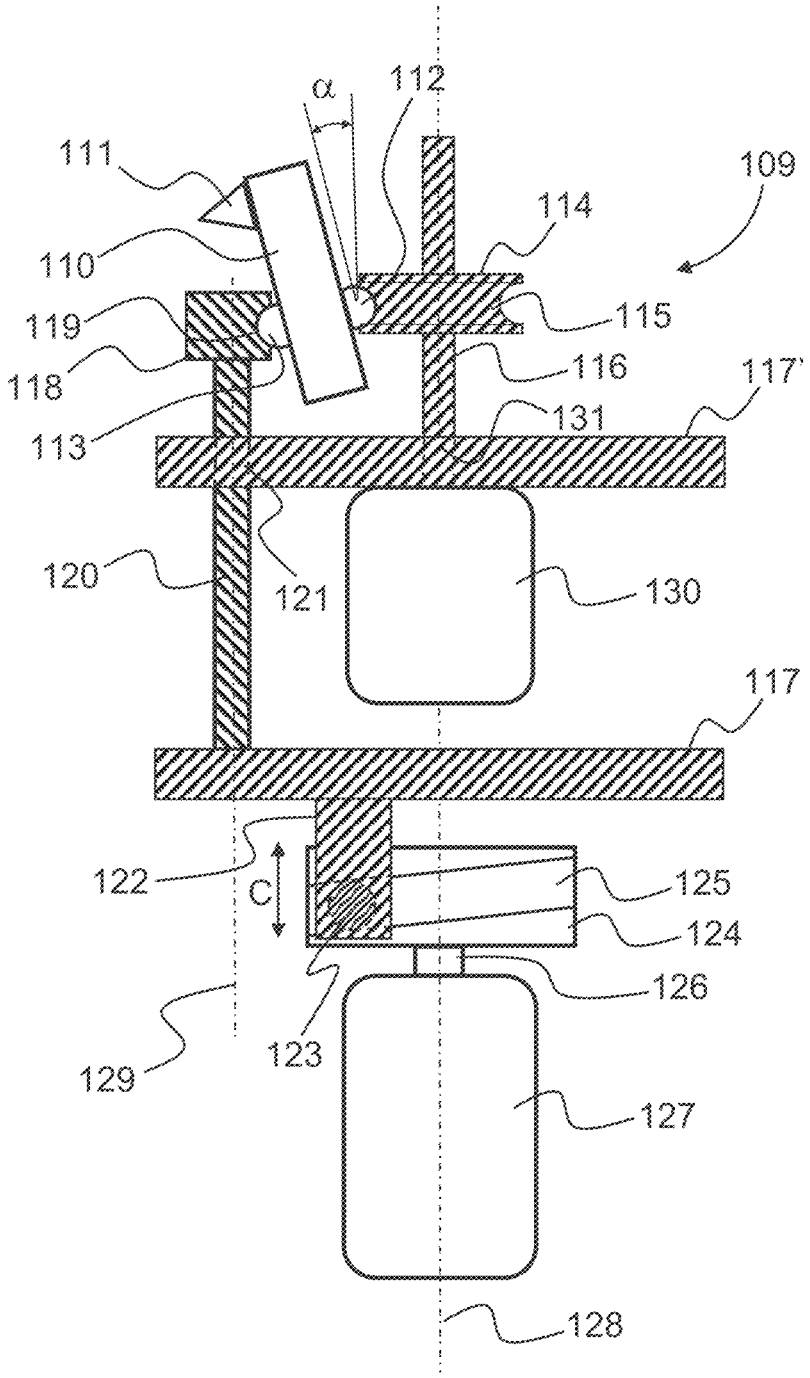
FIG. 20 is a schematic illustration of the functional principle of a target retaining, and releasing mechanism of an embodiment of a launching device according to the invention.
Figure 26:
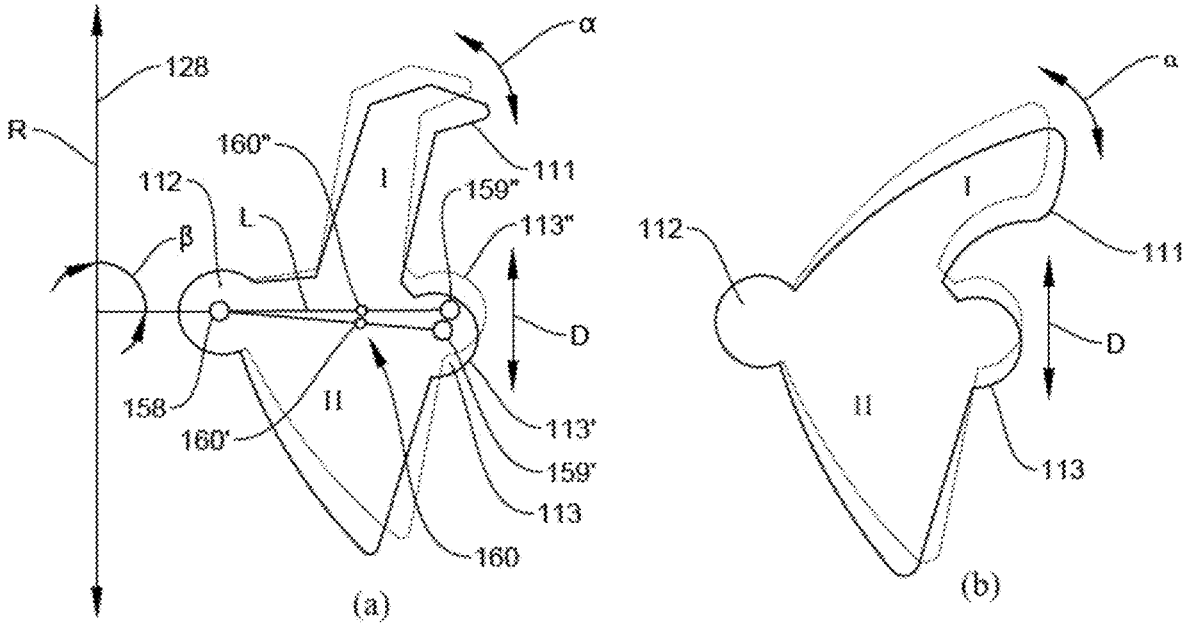
FIG. 26 is a schematic perspective view of a retaining claw member used in the embodiment shown in FIGS. 20 to 25.

With reference to FIG. 20 there is shown a schematic illustration of the functional principle of a further embodiment of a launching mechanism according to the invention generally indicated by reference numeral 109 in FIG. 20. Contrary to the embodiments described above, the central shaft member 116 is not longitudinally displaceable along the longitudinal axis 128 but fixed to the structure of the apparatus. Fixed to the central shaft member 116 there is provided a cylindrical inner guide member 114 provided with a circumferentially extending guide recess or groove 115 formed such that it corresponds to an inner extension 112 provided on the retaining claw member 110, 111, 112, 113 that is configured to retain the target on the launching head (which will be described detail below) during rotational acceleration of the launching head from approximately zero rotational speed to its terminal speed, at which the claw member releases the target from the launching head. An example of this claw member is shown in FIG. 26 below. The launching head including the inner guide member is rotated by the motor 130.

The rotational movement of the axe 126 of a second motor 127 is converted to a longitudinal displacement of the shaft or rod 120 by means of a first cylindrical member 124 fixedly mounted on the axle 126 of the motor 127. In the first cylindrical member 124 there is provided a circumferential recess or groove 125 that is in engagement with a similarly shaped guide member 123 fixedly connected via member 122 to a laterally extending plate member 117. The recess or groove 125 is inclined relative to the longitudinal axis 128 such that when the first cylindrical member 124 rotates, the engagement between the recess or groove 125 and the guide member 123 causes the plate member 117 to move vertically (as seen in the figure, cf. arrow C) in the direction of the longitudinal axis 128. This movement is transferred to an outer guide member 118 that is a part of the launching head and that is provided with a circumferentially extending recess or groove 119 formed for engagement with an outer extension 113 formed on the retaining claw member 110, 111, 112, 113. The longitudinal movement of the outer guide member 118 thereby causes the retaining claw member 110, 111, 112, 113 to pivot as indicated by the angle $\alpha$ between a state in which it retains the target to the launching head and a state in which it releases the target from the launching head.

It is noted that a complementary configuration of the rotation-to-displacement mechanism 122, 123, 124, 125 could alternatively be used. An embodiment of a complementary rotation-to-displacement mechanism is shown in FIG. 24*c* and will be described in connection herewith.

Figure 21:
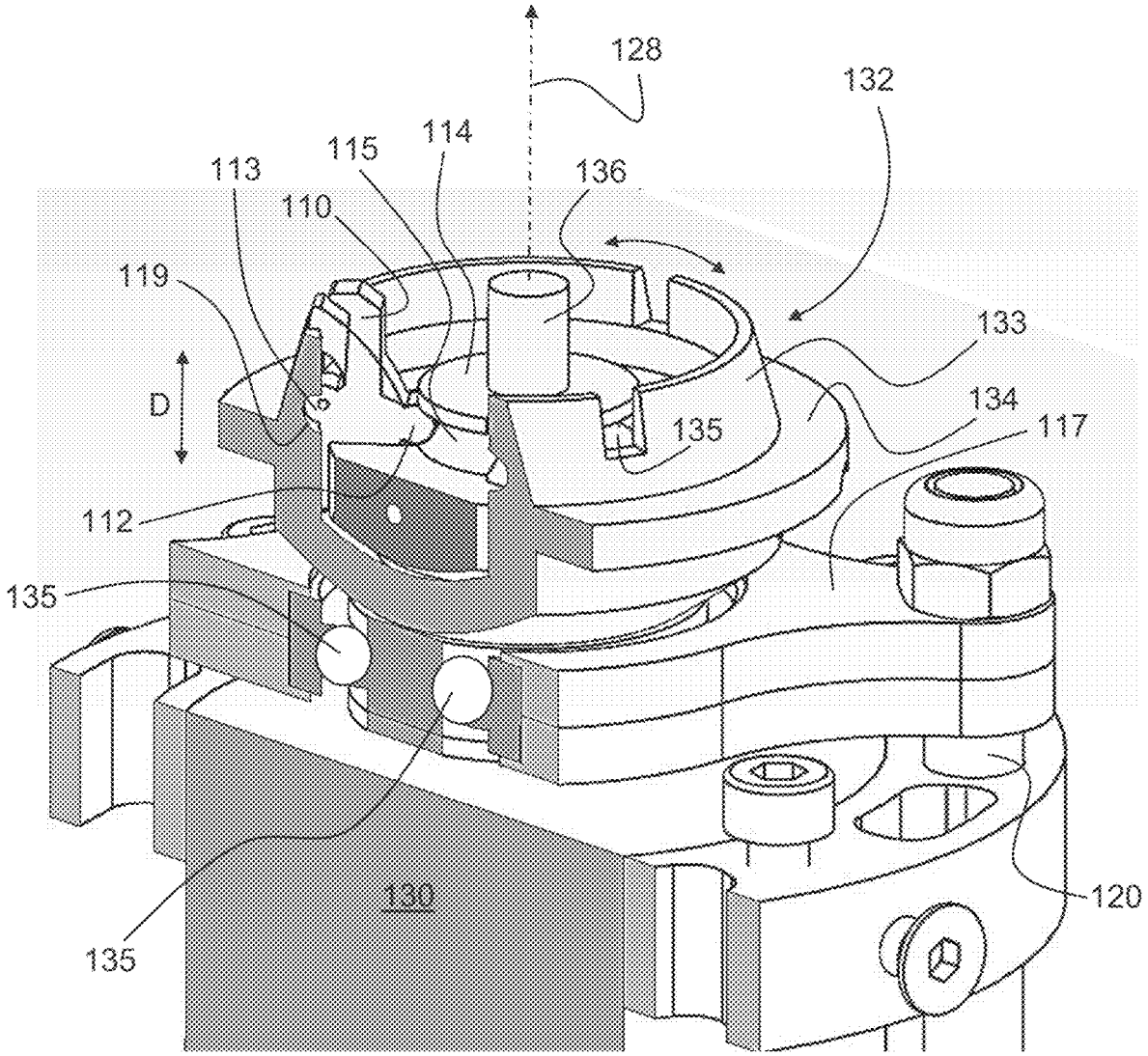
FIG. 21 is a schematic perspective a partly sectional view of the upper portion (i.e. the portion that contains the launching head upon which the target is placed) of an embodiment of a launching device according to the invention.

With reference to FIG. 21 there is shown a schematic perspective and partly sectional views of the upper portion (i.e. the portion that contains the launching head upon which the target is placed) of an embodiment of a launching device according to the invention.

In FIG. 21, reference numeral 132 generally indicates the launching head that comprises a conical tubular section 133 formed to accommodate the inner space 8 of the hub portion of the target and a plane portion 134 upon which the target is placed, such that the conical section 133 supports the inner space of the hub portion of the target. The launching head is configured to be able to rotate about the longitudinal axis 128 driven by the motor 130.

The inner guide member 114 is fixedly attached to the axle 136 of the motor 130 at a fixed position along the rotational axis 126. The inner guide member 114 is as described above provided with a circumferentially extending guide recess or groove 115 in engagement with an inwardly extending protrusion 112 provided on the retaining claw member 110, thereby establishing a longitudinally (along axis 128) fixed hinge about which the retaining claw member 110 van pivot. Two positions of the retaining claw member are shown in FIG. 21.

The launching head further comprises the body portion 133, 134, which portion is configured to undergo vertical movement (displacement along the rotational axis 128 in the direction indicated by arrow D. An inner circumferential wall portion of the body 133, 134 is provided with a circumferentially extending recess or groove 119 formed for engagement with a radially outwardly extending protrusion 113 provided on the retaining claw member 110. When the body portion 113, 114 undergoes a displacement as indicated by arrow D, the retaining claw member 110 will be forced to undergo a pivotal movement about the hinge portion established by the engagement between the guide recess or groove 115 that is in engagement with the inwardly extending protrusion 112 provided on the retaining claw member 110. Thereby, a longitudinal displacement along axis 128 of the body portion 133, 134 will be converted into a pivotal movement of the retaining claw member 110 between a state, in which it retains the target to the launching head and a state, in which the target can leave the launching head and commence its movement along a chosen trajectory in space.

The conical portion 133 of the launching head is provided with suitable recesses or slits 135 through which the retaining claw members can pass. In the figures, three retaining claw members 110 are shown equally angularly distributed in the launching head, but it is understood that other numbers of retaining claw members could also be used.

The body portion 133, 134 must be able to undergo both longitudinal displacement and to rotate in unison with the inner guide member 114. This is in the shown embodiment made possible by connecting the body portion 133, 134 to the laterally extending plate member 117 via a ball bearing 135 such that the body portion 133, 134 can rotate about the rotational axis 128 relative to the plate member 117 and such that a displacement of the plate member 117 in the vertical direction as indicated by arrow D will cause the body portion 133, 134 to undergo a similar vertical displacement.

Figure 22:
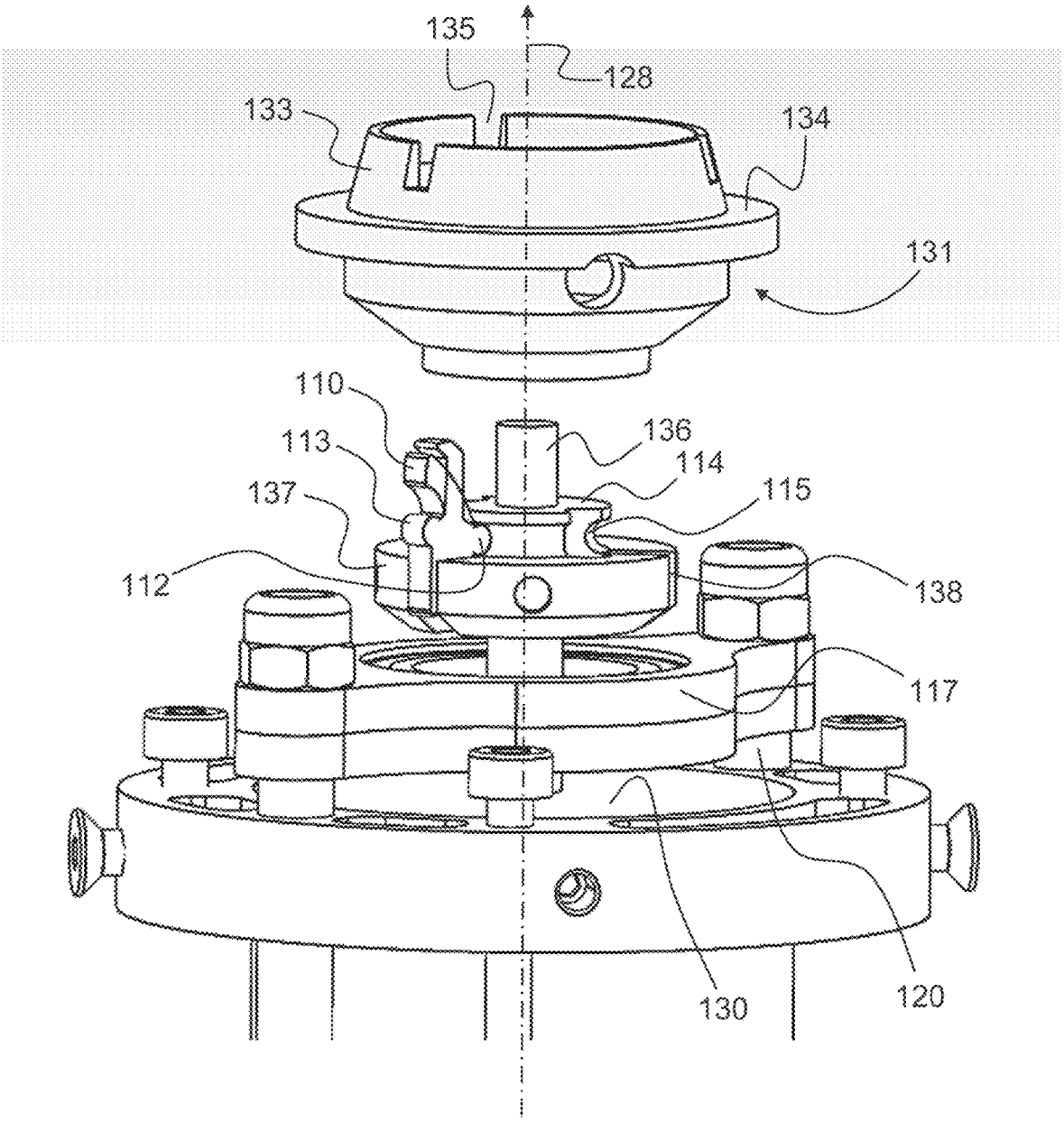
FIG. 22 is a perspective and partly exploded view of an embodiment of the launching head and various associated drive means.

With reference to FIG. 22 the embodiment of the launching head and various associated functional means are shown in a perspective and partly exploded view. In FIGS. 21 and 22 identical elements are designated by the same reference numeral.

FIG. 22 shows the outer guide member of the launching head generally designated by reference numeral 131 that on its outer surface comprises the conical portion 133 and the pane portion 134. The conical portion 133 is provided with slits 135 that accommodate a portion of the retaining claw members. FIG. 22 further shows the rotation axle 136 of the motor 130 that rotates the launching head and the inner guide member 114 with its circumferential recess or groove 115. One of the retaining claw members 110, 112, 113 is shown in two positions hereof. The inner guide member 114 is positioned on top of a cylindrical body 137 that is provided with slits 138 for a portion of the retaining claw members. The outer guide member 131 is attached rotatably to the lateral plate member 117 via the ball bearings 135 shown in FIG. 21, such that the outer guide member 131 can be displaced longitudinally by means of the lateral plate member 117 driven by the shaft member or rod 120.

Figure 23:
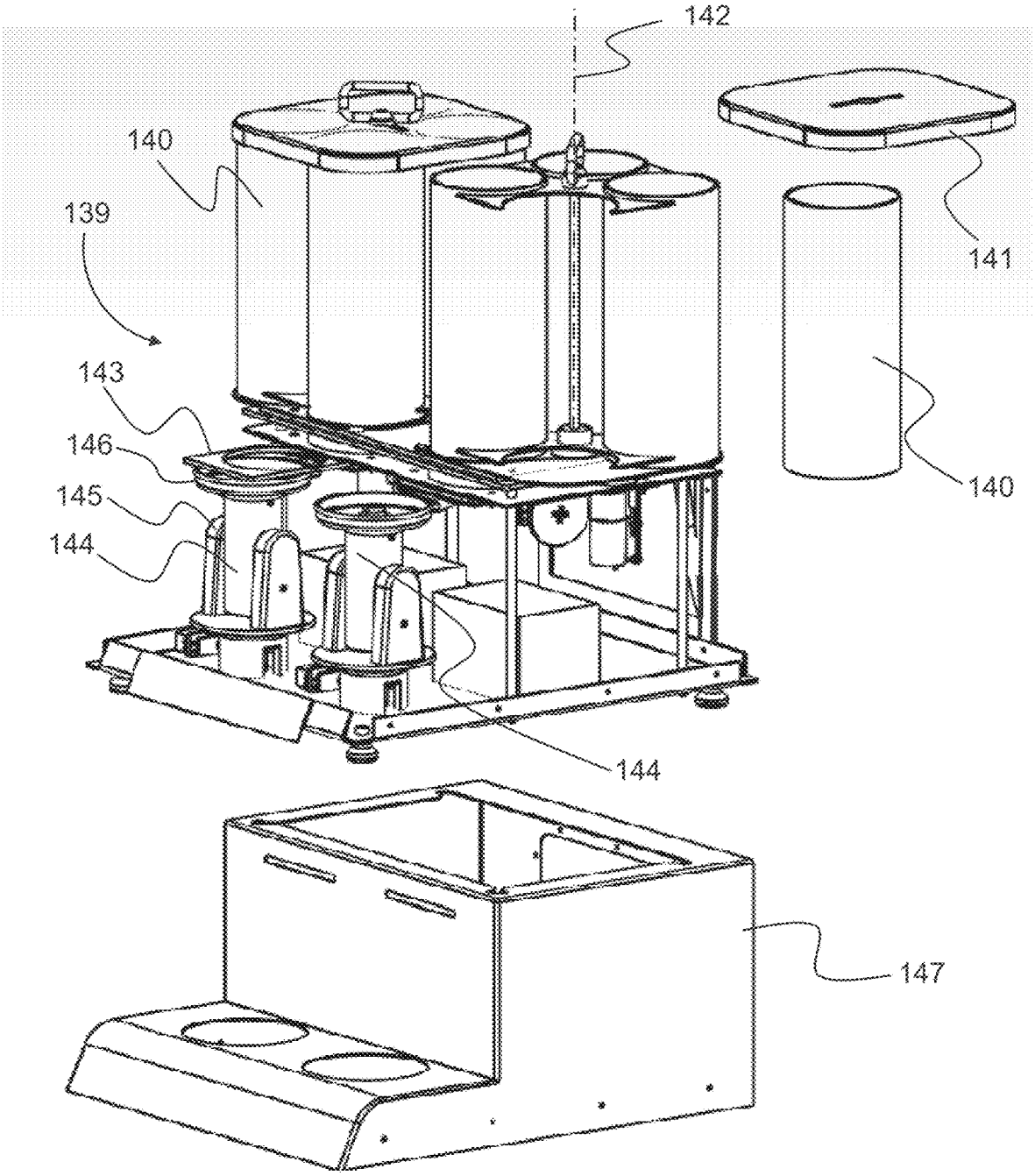
FIG. 23 is a schematic, perspective and partly exploded view of an embodiment of a launching apparatus according to the invention.

With reference to FIG. 23 there is shown a schematic, perspective and partly exploded view of an embodiment of a launching apparatus according to the invention generally indicated by reference numeral 139.

The apparatus according to this embodiment comprises basically a housing 147 with an internal support structure upon which a number of rotatably mounted magazines 140 for accommodating a plurality of targets according to the invention are provided. The magazines are provided with a suitable lid 141. The apparatus further comprises (in the shown embodiment) two separate launching devices 144 comprising the launching head and associated functional mechanisms that is described above. Each launching device 144 is pivotally mounted on support members 145, such that a target can be launched at a desired angle relative to horizontal. The two launching devices 144 can be set to different or identical launching angles as desired.

Figure 24A:
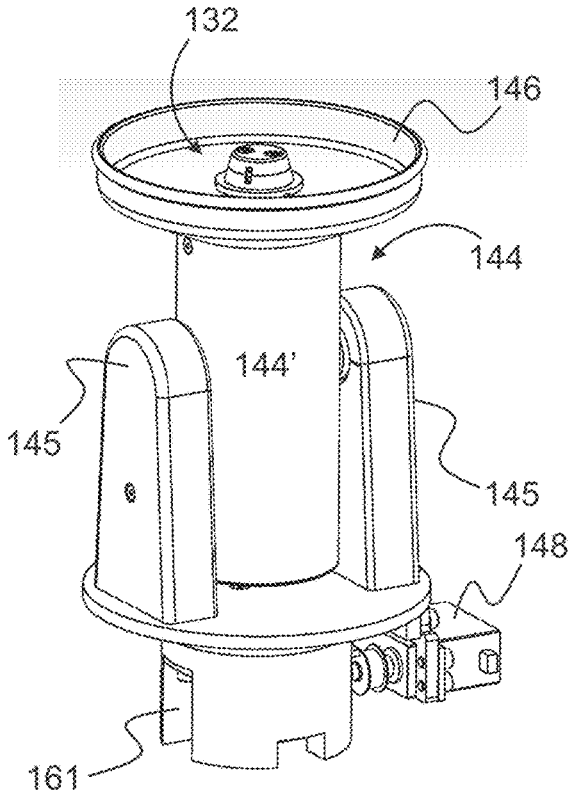
FIGS. 24*a* to 24*c* are schematic perspective views of the launching device and launching head used in the apparatus shown in FIG. 23.

The apparatus is configured such that a target (i.e. the lowermost target in a given magazine) is picked up by slidable/displaceable pickup means 143 and transferred to a position immediately above a receiving tray 146 on the upper longitudinal end of the launching device (cf. FIG. 24*a*). When a target is transferred from the magazine to the receiving tray 146, the launching device 144 is in a vertical position such that the target drops downwards into the receiving tray 146 by the effect of gravity. When the target is transferred to the receiving tray, and hence is correctly positioned on the launching head and locked to the launching head by the retaining claw members, the launching device is pivoted into its desired angle, after which the launching head and hence the target is accelerated from zero to the desired terminal rotational speed and when this is reached, the target is automatically released from the launching head. The apparatus according to the invention is provided with sensor and control means that determine if the desired terminal rotational speed is reached and in this case releases the target from the launching head when this speed is reached.

It is understood that the two launching devices during use can have different elevation angles and also that there may be provided other numbers of launching devices on the apparatus that the two shown in FIG. 23.

Corresponding to each separate launching device 144 there is provided a number of magazines or containers 140 that can accommodate a stack of targets. Prior or during use, these magazines 144 is filled with a sufficient number of targets. When a given magazine 140 is empty, a succeeding magazine can be rotated about axis 142 in place for providing targets to the apparatus through a target providing mechanism that comprises the receiving extendable tray member 143 that is configured to receive a target from the magazine and bring it into a position directly above a conically shaped receptor 146 mounted on a launching head provided at the upper longitudinal end (as seen in the figure) of the launching device 144. When the target is placed on the launching head it is rotated from zero rotational speed to the desired terminal rotational speed, at which it is released by the retaining claw members. In the shown apparatus, three such members are provided, but it is understood that other numbers of retaining claw members may be used.

Figure 24B:
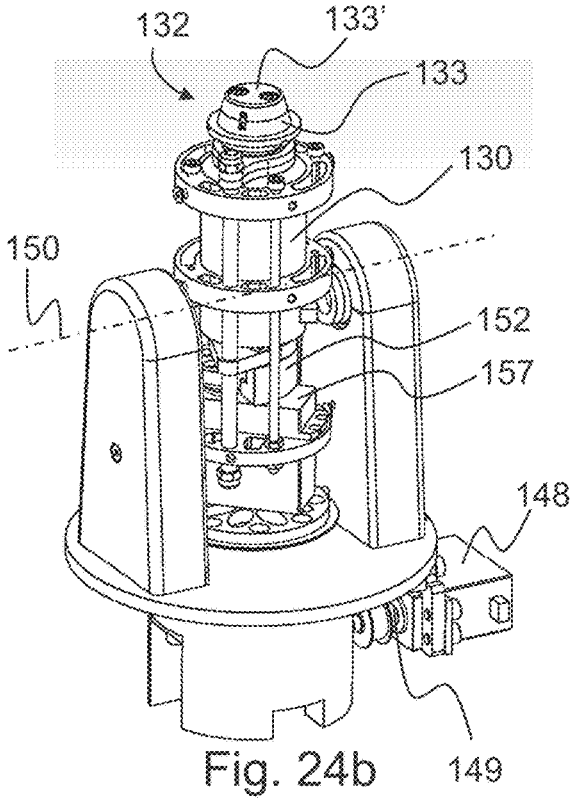
Figure 24C:
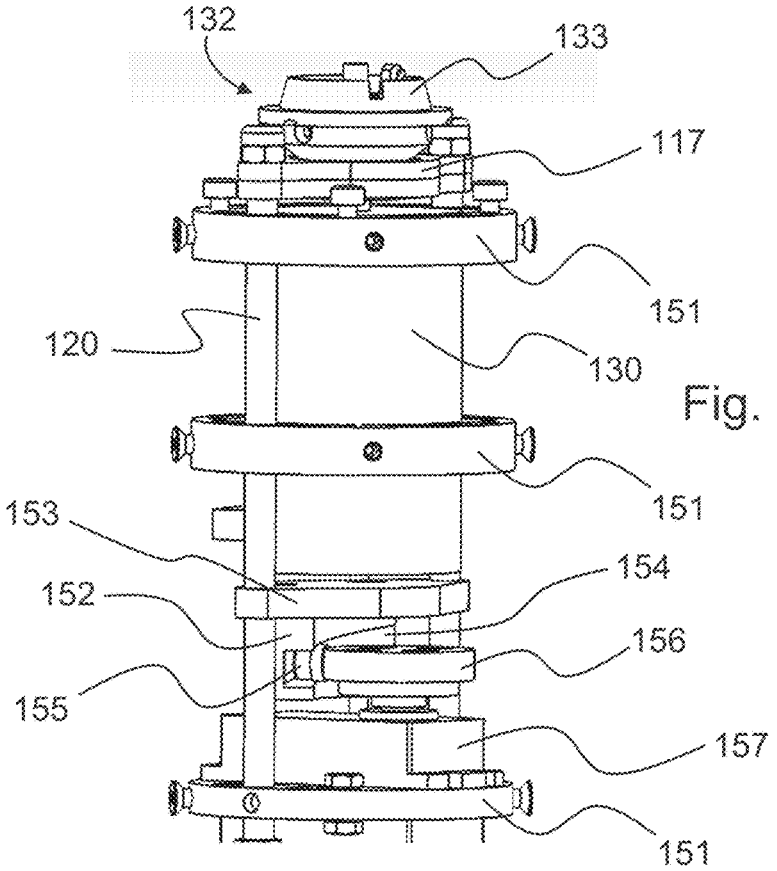

With reference to FIGS. 24*a*, 24*b* and 24*c*, a practical implementation of the embodiment of a launching device 144 according to the invention and specifically used in the apparatus shown in FIG. 23 is shown. Only a few of the details that are described in the preceding figures are indicated and these details/elements are designated be the same reference numerals as used in previous figures.

FIGS. 24*a*, 24*b* and 24*c* shows a launching device 144 according to an embodiment of the invention. Various drive means for the launching head 132 are accommodated within the cylindrical housing 144'. The launching head 132 is centrally located in the tray member 146 that was described previously. The launching device 144 is supported by support members 145 such that the launching device 144 can be pivoted about a lateral axis 150 relative to the support members 145. This pivotal movement is obtained by means of a pivot motor 148 via a suitable functional connection, such as a belt or chain, generally indicated by 149 (FIG. 24*b*). The drive mechanism for the launching device 144 comprises three electrical motors or similar means: the drive motor 130 that rotates the launching head 132, the motor or similar means 157 that opens/closes the retaining claw members via a rotation-to displacement means 152, 154, 155, 156 described above and the pivot motor 148. Even though the term "motor" is used throughout this specification, it is understood that any kind of suitable "actuator" means could be used.

The housing 144' is attached to the inner structure of the launching device 144 via the tubular members 151 shown in FIG. 24*c*.

On top (as seen in FIGS. 24*a* and 24*b*) of the conical tubular section 133 there is provided a closing cap member 133' that are also provided with slits for accommodating a part of the retaining claw members.

Figure 25:
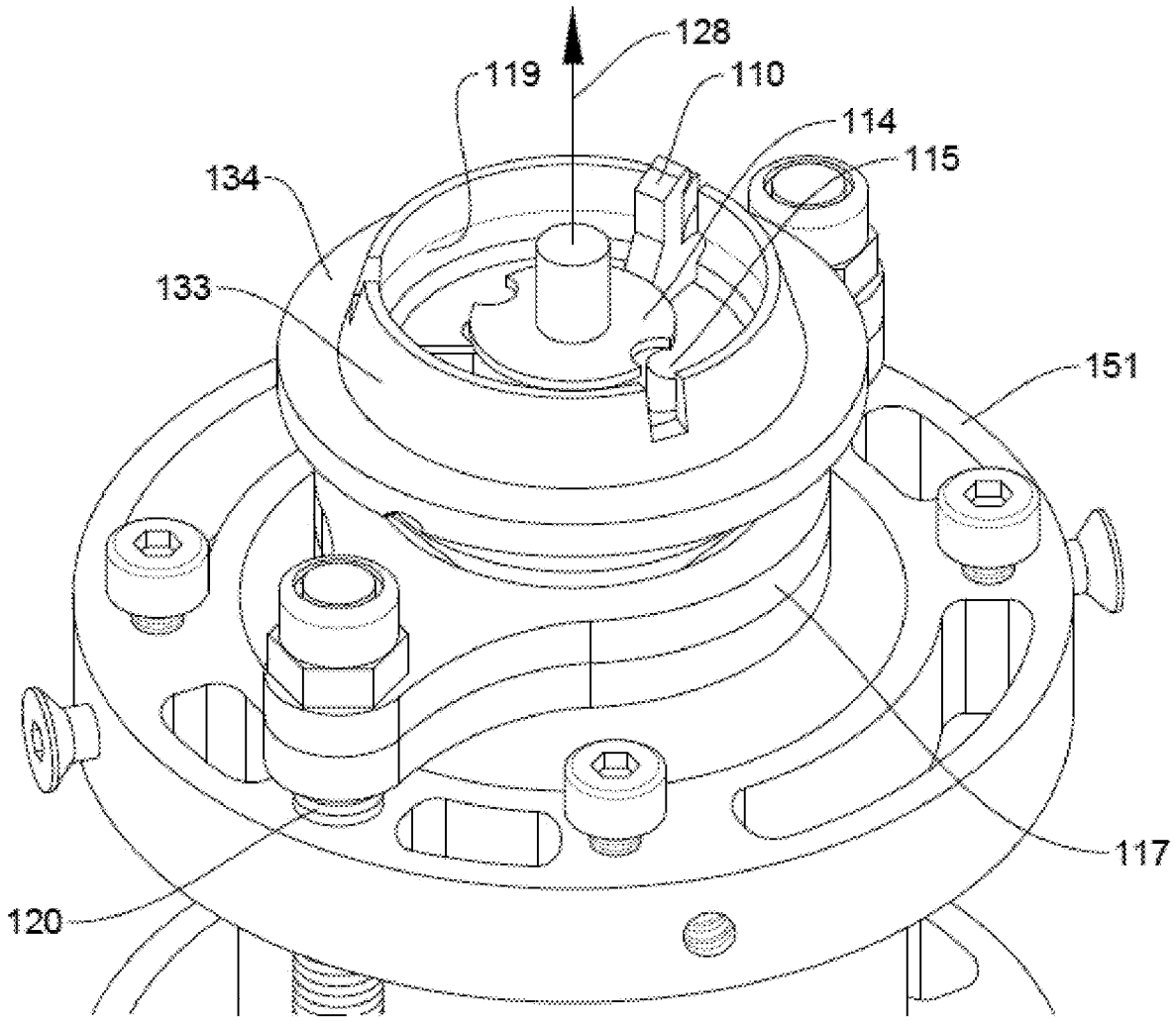
FIG. 25 is a perspective view of details of the launching head of the embodiment shown in FIGS. 20 to 24.

With reference to FIG. 25 there is shown a perspective view comprising the launching head and the lateral plate member 117 according to this embodiment of the invention. FIG. 25 shows the body portion of the launching head comprising the conical portion 133 that is formed for insertion into the inner space of the hub of the target and the planar platform portion 134 upon which the target rests. Also shown are the inner guide member 114 with the circumferential groove 115 and the circumferentially extending recess or groove 119 on the inner wall portion of the outer guide member 133, 134. One of the retaining caw members 110 is also shown. The body portion of the outer guide member 133, 134 is mounted as described above on the lateral plate member 117, such that the body portion of the outer guide member 133, 134 can rotate and undergo longitudinal displacement as described above. The plate member 117 is displaced by means of the rod 120 as described above. The longitudinally extending rotational axis 126 is also indicated in FIG. 25.

With reference to FIGS. 26(*a*) and 26(*b*) there are shown two specific designs of the retaining claw member 110 that is used in the invention. It is understood that other suitable designs comprising similar main functional details could also be used.

The basic features of the retaining, claw members according to the invention are illustrated in FIG. 26(*a*). The retaining claw member comprises an upper section I (as seen in the figure) and a lower section II separated by the line L connecting the center point 158 of the extension 112 that is in engagement with the circumferential groove 115 of the inner guide member 114 with the center point 159', 159" of the extension 113 that is engagement with the circumferentially extending recess or groove 119 on the inner wall portion of the outer guide member 133, 134. The body of the retaining claw member is configured such that the center of gravity 160', 160" is located on this line. As it appears in FIG. 26(*a*), when the retaining claw member is pivoted from the state in which the target is retained on the launching head to the state in which the target is released from the launching head, the center of gravity moves from the position indicated by 160' to the position indicated by 160". In the latter state, the line L forms an angle with the rotational axis 128 of substantially 90 degrees. This configuration of the retaining claw members minimizes the force required on the shaft member or rod 120 and provided by the motor 157 and hence facilitates release of the target from the launching head despite the powerful centrifugal forces acting on the retaining claw members due to the very high rotational speed of the launching head at the time of release of the target.

Another geometrical configuration of the retaining claw member is shown in FIG. 26(*b*). The retaining claw member shown in FIG. 26(*b*) has the same basic features as described above in relation to FIG. 26(*a*). The main difference between the claw members shown in FIGS. 26(*a*) and 26(*b*) is the detailed shape of the claw portion 111 that retains the target to the launching head. It is however essential for any claw member configuration for used according to the present invention that those surfaces of the claw portions 111 that are in contact with the target or can come in contact with the target during release of the target from the launching head have rounded corners (and not sharp corners) in order not to cause damage to the target during release, as even a minor damage to the target during release will be likely to entirely disintegrate the target due to the very high rotational speed of the target at release.

In preferred embodiments of the retaining claw members according to the invention, the configuration of the claw members shown in FIGS. 26*a* and 26*b* is such that the following apply (c.f. FIG. 26*a*, but similar principles apply to the claw member shown in FIG. 26*b*):

The claw member (shown in two pivotal states) rotates about the rotational axis R indicated by reference numeral 128 and is pivotally mounted such that it can pivot about the extension 112 (pivot point 158). When the opposite extension 113 is displaced longitudinally as indicated by arrow D from the lower longitudinal position 113' (in which the claw member retains the target to the launching head) to the upper longitudinal position 113" (in which the claw member releases the target from the launching head), the center of gravity 160 moves from position 160' to the position 160", which is located on the line L extending from the center 159 of the outer extension 113 through the center of the inner extension 158 and forms an angle β of approximately 90 degrees to the longitudinal axis 128. Thereby, the section I of the claw member located above the center of gravity and the section II of the claw member located below the center of gravity are exposed to equal centrifugal forces, when the launching head rotates about the longitudinal axis 128. This configuration of the claw members results in that the force which must be transferred from the motor 157 via the shaft or rod 120 to the outer extension 113 for releasing the target from the launching head is minimized.

Figure 27:
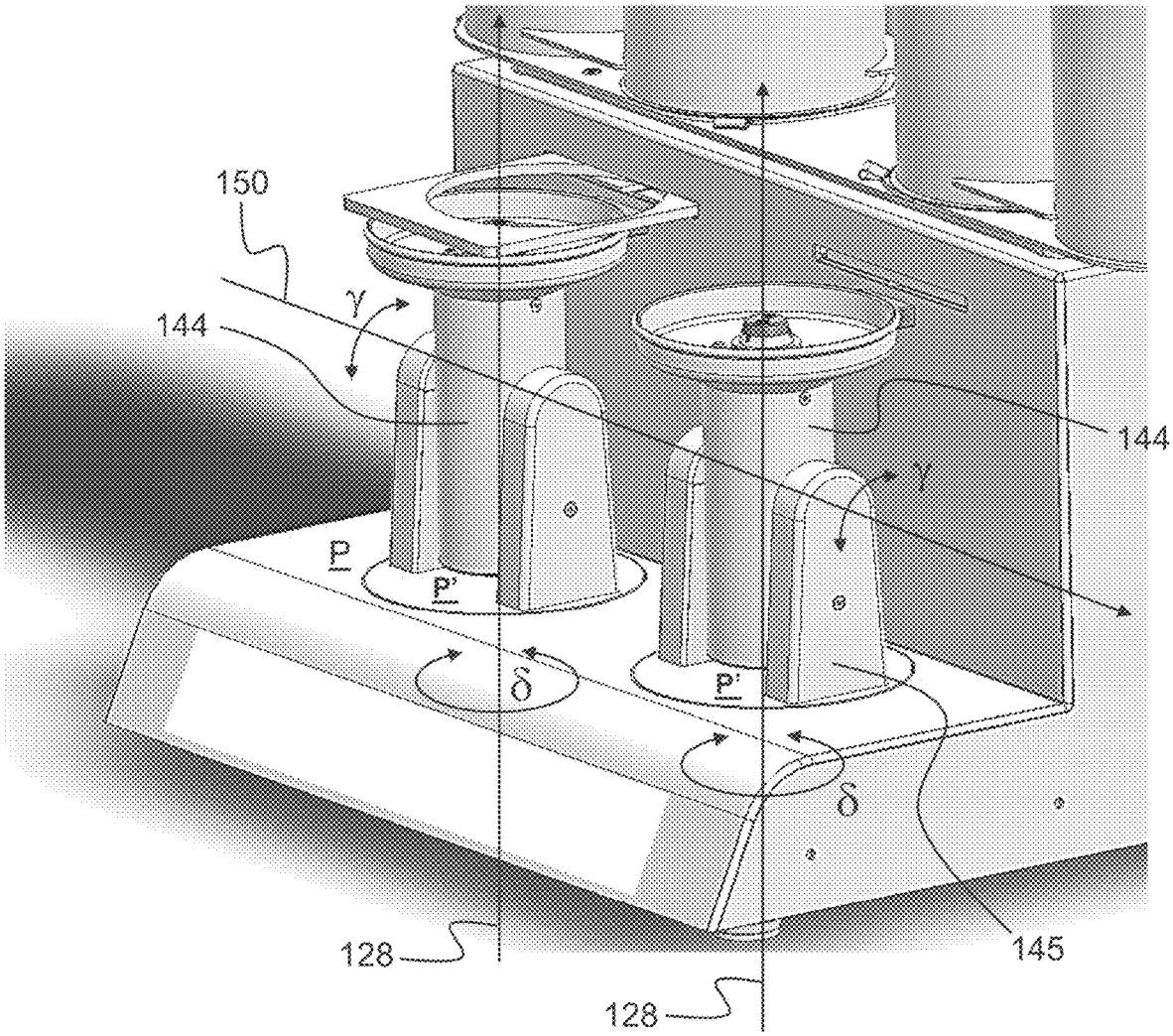
FIG. 27 is a schematic representation of a portion of a launching apparatus according to an embodiment of the invention illustrating possible pivotal and rotational movements of the launching devices of the apparatus.

With reference to FIG. 27 there is shown a schematic representation of a portion of a launching apparatus according, to an embodiment of the invention illustrating possible pivotal and rotational movements of the launching devices of the apparatus.

The apparatus shown partly in FIG. 27 comprises two launching devices 144 mounted on a surface P of the apparatus. On a portion P' of the respective launching device 144 the support members 145 that allow pivotal movement of the launching devices (i.e. changing the elevation of the respective launching device) of the respective launching devices 144 are provided, such that the portion P' and hence the support members 145 can rotate about the axis 128 as indicated by the angle δ. Hence, each launching device 144 can undergo a combination of rotation about the axis 128 that extends perpendicularly to the surface portion P of the apparatus and a pivotal movement changing, the elevation angle γ of the respective launching, device. By these means, each respective launching device can be brought to different launching directions relative to the apparatus.

Figure 28:
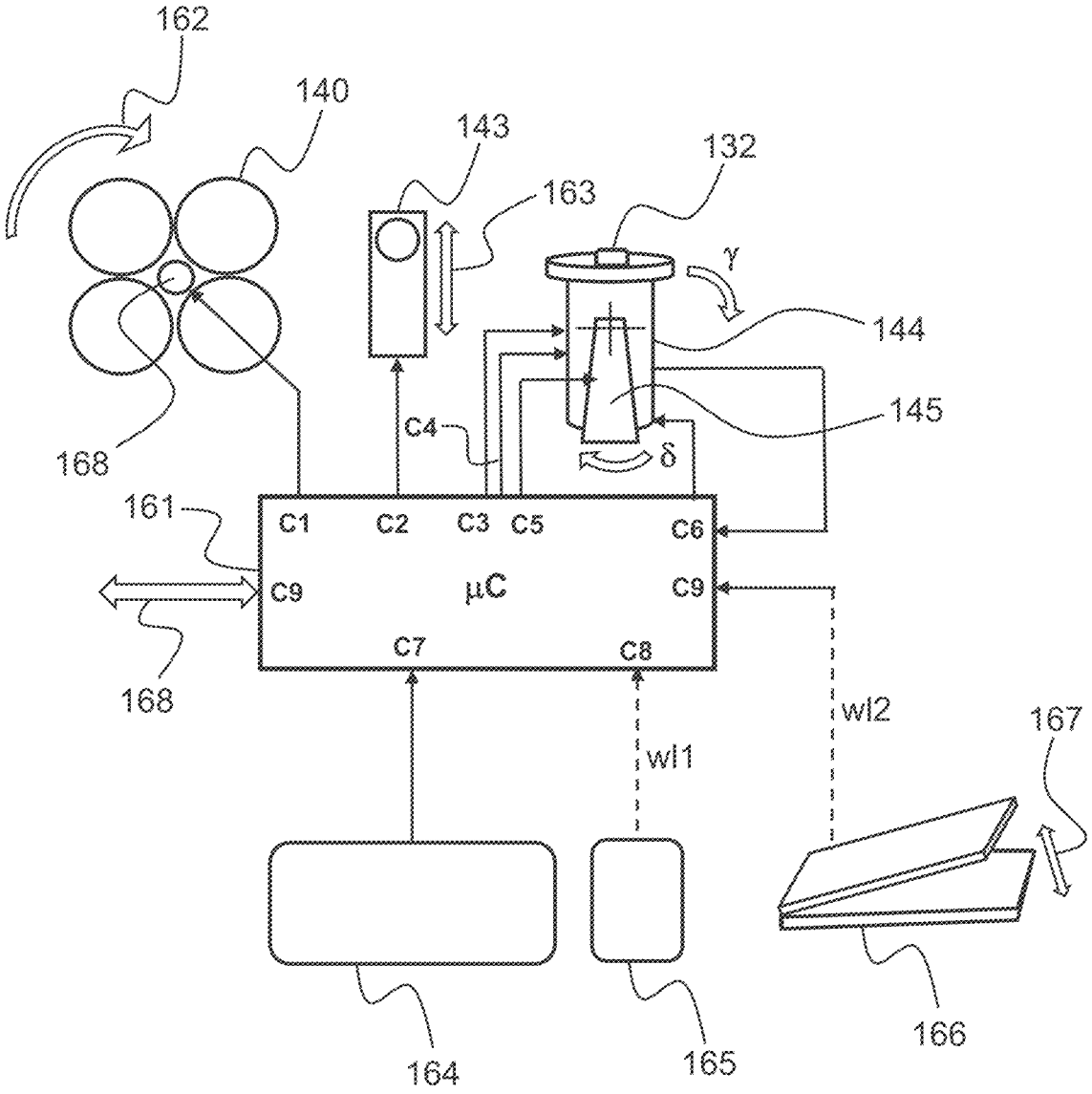
FIG. 28 is a schematic block diagram of an embodiment of a control system and user interface means according to the invention.

With reference to FIG. 28 there is shown a schematic block diagram of a control system configured to control the main functions of the apparatus according to an embodiment of the invention. It is however understood that a control system for the apparatus according to the invention may comprise other functional units etc. than those shown in FIG. 28.

In the shown control system, the microcontroller 161 comprises the necessary software configured for receiving signals/instructions from a user or programmer that sets up the control system. Fixed/pre-programmed functions can be selected, and specific parameter settings can be chosen/adjusted by the user via a user control panel 164 provided on an outer surface portion of the apparatus. The user control panel communicates with the microcontroller 161 as indicated by c6 that commonly designates those control signals that are provided from the user control panel 164 to the microcontroller 161. It is furthermore possible for the user to program the control system from a dedicated user programming interface 165 that preferably communicates with the microcontroller 161 (c7) by means of wireless communication (wl1).

The microcontroller 161 provides control signals the the various functional entities of the apparatus. Thus, a control signal c1 is provided to a motor 168 that rotates the magazines 140 when one of the magazines 140 is empty and a new need to be ready to transfer targets to the target receiving tray 143. Further, a control signal c2 controls the target receiving tray to move form a position in which it can receive a target from the magazine 140 that is located above the tray 143 to a position above the launching head 132 of the corresponding launching device 144. A control signal c5 controls the elevation γ of the launching device 144 and a control signal c6 controls the azimuth δ of the launching device 144. A control signal c4 initiates the release process of the target from the launching head 132. Initiation of the release process can be controlled by the user by means of for instance a pedal 166, 167 that may communicate with the apparatus through a wireless connection wl2. At c6 the microcontroller 161 receives information of the rotational speed of the launching head, based on which information it activated the release process.

The microcontroller 161 can, if desired, communicate with other apparatuses according to the invention via connection 168 by sending control signals c10 to other apparatuses. Other apparatuses can also communicate with the present apparatus via connection 168 thereby forming a complete chain of interconnected apparatuses according to the invention.

It is understood that the control system of the apparatus according to the invention may comprise further features than those actually described above without departing from the scope of protection of the present invention.

The configuration of the launching apparatus according to the invention as well as the individual controllability of the launching devices as described above opens up for a number of interesting operational conditions of the apparatus that can be programmed into appropriate control systems provided in the apparatus either from the factory or/and individually by the end user of the apparatus.

Some of these possibilities are briefly outlined below relating to a specific practical implementation of the apparatus according to the invention:

- The apparatus shown in FIGS. 23 and 27 can launch two targets simultaneously or with a delay of up to four seconds of the second target relative to the first target.
- The launching speed of the targets is up to 120 km/h and the range is up to 120 meters depending on whether conditions.
- The targets rotate with a rotational speed of between 12000 rpm and 32000 rpm prior to launching, which provides a very high directional stability of the targets.
- The apparatus will typically have eight fixed programs and up to an additional eight user defined programs.
- The apparatus is provided with a wireless user interface inter alia for programming the apparatus as well as a wireless foot pedal to release the target from the apparatus.
- Launching can be delayed up to five seconds after the foot pedal is activated in order to give the shooter time to put on the gun before launching the target.
- If desired, the apparatus can launch up to four targets at different speeds (and if desired different launching directions relative to the apparatus). Thus, for instance two targets can initially be launched with a given (lower) launching speed followed by two additional targets launched at a higher launching speed, whereby the latter two catches up with the two first targets, when the targets enter the shooting area of the shooter.
- A plurality of apparatuses according to the invention can be inter connected such that a flock of up to sixteen targets can be in the air together.
- The apparatus has a vertical range of approximately 125 to 150 meters such that shooting of migratory birds (such as geese) can be practiced.
- During user-programming of the apparatus, the different components of the apparatus moves in accordance with the programming, which greatly facilitates user-programming of the apparatus.
- The apparatus may be power supplied by batteries and can launch approximately 5000 targets on a single charging.
- The magazines may typically accommodate up to 200 targets. Thus, the plurality of magazines on the shown embodiments can provide 400 targets before re-loading, of the magazines becomes necessary.
- The magazines may accommodate any kinds of targets according to the invention,
- The launching devices provided on the apparatus are basically completely independent entities. Thus, for instance, one launching device can launch a target while the other is loaded with a new target. This results in that the apparatus can launch targets with two seconds interval.
- The effective elevation range of the launching devices is from 0 degrees (horizontal) to 90 degrees (vertical) and the effective azimuth range of the launching devices is 160 degrees (+/−80 degrees relative to the frontal direction from the apparatus).

At least two types of targets according to the invention is available: a target for use at low wind speeds (weight of target 6 grams) and targets for use at higher wind speeds (weight of target 13 grams). The light targets affect the environment minimally and are also cheaper than the heavier targets. A preferred version of the targets of the invention are reversible ("turnable") which greatly facilitates loading of the targets into the magazines of the apparatus. The targets may be obtainable in 1000-piece packages, which saves packing and is advantageous for the environment.

The invention claimed is:

1. A sports shooting target made of a biodegradable material, the target having a rotational axis (z) and attachment means configured for releasable attachment of the target to a launching head of a launching device, wherein the target is provided with trajectory stabilizing means that are configured to stabilize the trajectory of the target by gyro effect caused by rotation about said rotational axis (z) which stabilizing means further function as propelling means that cause forward movement of the target along its trajectory due to the rotation about said rotational axis (z), when the target is rotating, wherein said stabilizing means comprises a fan comprising fan blades that rotates in unison with the target, when the target rotates, such that the stabilizing means both provides said stabilizing gyro effect and forward propulsion (movement) of the target along a chosen trajectory wherein:

- the sports shooting target comprises a hub portion configured for releasable attachment to a corresponding portion of a launching head of a launching device; and
- the hub portion is provided with an inner circumferential surface facilitating release of the target from said portion of the launching head and defining an inner space;
- the target comprises a plurality of concentric ring members arranged about the rotational axis (z) of the target at different distances from the rotational axis (z) and outside the hub portion;
- the stabilizing means comprises first fan blades that extend radially from the hub portion to the ring member provided at the largest distance from the rotational axis (z); and
- wherein the hub portion further comprises inwardly sloping surfaces that converge towards the longitudinal rotational axis (z) of the target, wherein the sloping surfaces have similar slope angles relative to the longitudinal axis (z), whereby the hub portion of the target is attachable to the launching head from either side of the target.

2. A sports shooting target according to claim 1, wherein said ring members have cross-sectional shapes comprising curved first and second side faces, wherein the first and second side faces meet at a substantially sharp edge portion, thereby optimizing the aero-dynamic properties of the respective ring members.

3. A sports shooting target according to claim 1, wherein said second fan blades are provided between the outermost ring member and the adjacent ring member.

4. A sports shooting target according to claim 1, wherein the inclination angle of the fan blades relative to an (x, y) plane of the target increases towards the hub portion.

5. A sports shooting target according to claim 1, wherein said inner circumferential surface of the hub portion is conical.

6. A sports shooting target according to claim 1, wherein the plurality of concentric ring members comprises an innermost ring member located closest to the hub portion, a middle ring member and an outermost ring member located furthest from the hub portion, the second fan blades extending radially only between the middle ring member and the outermost ring member.

* * * * *